US009576530B2

(12) United States Patent
Kanda et al.

(10) Patent No.: US 9,576,530 B2
(45) Date of Patent: Feb. 21, 2017

(54) ELECTRO-OPTICAL DEVICE

(71) Applicant: SAMSUNG DISPLAY CO., LTD., Yongin, Gyeonggi-Do (KR)

(72) Inventors: Eiji Kanda, Yokohama (JP); Takeshi Okuno, Yokohama (JP); Masayuki Kumeta, Yokohama (JP); Daisuke Kawae, Yokohama (JP); Ryo Ishii, Yokohama (JP); Naoaki Komiya, Yokohama (JP)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 22 days.

(21) Appl. No.: 14/468,914

(22) Filed: Aug. 26, 2014

(65) Prior Publication Data

US 2015/0054722 A1 Feb. 26, 2015

(30) Foreign Application Priority Data

Aug. 26, 2013 (JP) ..... 2013-174761

(51) Int. Cl.
*G09G 3/3233* (2016.01)
*G09G 3/32* (2016.01)

(52) U.S. Cl.
CPC .... *G09G 3/3233* (2013.01); *G09G 2300/0852* (2013.01); *G09G 2300/0861* (2013.01); *G09G 2320/0295* (2013.01); *G09G 2320/045* (2013.01); *G09G 2320/0673* (2013.01)

(58) Field of Classification Search
CPC ..... G09G 3/3233; G09G 3/3258; G09G 2300/0852; G09G 2300/0861; G09G 2300/0439;G09G 2320/0295; G09G 2320/045; G09G 2320/0673; G09G 2320/041; G09G 2320/043
USPC ..... 345/77
See application file for complete search history.

(56) References Cited

U.S. PATENT DOCUMENTS

| | | | | |
|---|---|---|---|---|
| 4,530,017 | A | 7/1985 | Oishi et al. | |
| 4,593,868 | A | 6/1986 | Sato et al. | |
| 4,877,261 | A | 10/1989 | Heisson | |
| 6,995,519 | B2 * | 2/2006 | Arnold | G09G 3/3225 315/169.3 |

(Continued)

FOREIGN PATENT DOCUMENTS

| | | |
|---|---|---|
| EP | 2461311 A2 | 6/2012 |
| JP | 2003-330418 | 11/2003 |

(Continued)

*Primary Examiner* — Tom Sheng
(74) *Attorney, Agent, or Firm* — Lee & Morse P.C.

(57) ABSTRACT

An optoelectronic device includes a first transistor, a second transistor, and a control circuit. The first transistor is electrically connected between a power supply and a light-emitting element, has a gate to receive a gray scale voltage, and supplies the light-emitting element with a driving current corresponding to the gray scale voltage. The second transistor has a gate electrically connected to an electrode of the light-emitting element and a source or drain electrically connected to a circuit including a voltmeter. The control circuit reads a measurement value of the voltmeter when the gate of the first transistor receives the gray scale voltage, and corrects a next gray scale voltage applied to the gate of the first transistor based on the measurement value.

20 Claims, 25 Drawing Sheets

(56) References Cited

U.S. PATENT DOCUMENTS 8,026,876 B2 * 9/2011 Nathan ..... G09G 3/3233 315/169.3
8,339,386 B2 12/2012 Leon et al.
2005/0179626 A1 * 8/2005 Yuki ..... G09G 3/3233 345/76
2006/0273997 A1 * 12/2006 Nathan ..... G09G 3/3241 345/78
2008/0048951 A1 * 2/2008 Naugler, Jr. ..... G09G 3/006 345/82
2008/0111773 A1 * 5/2008 Tsuge ..... G09G 3/3241 345/76
2009/0051628 A1 * 2/2009 Kwon ..... G09G 3/3233 345/77
2010/0073346 A1 * 3/2010 Min ..... G09G 3/3291 345/211
2010/0182303 A1 * 7/2010 Takasugi ..... G09G 3/3233 345/211
2010/0214273 A1 * 8/2010 Shirouzu ..... G09G 3/3233 345/205
2010/0253706 A1 * 10/2010 Shirouzu ..... G09G 3/2092 345/690
2010/0259527 A1 * 10/2010 Odawara ..... G09G 3/3233 345/211
2011/0074762 A1 * 3/2011 Shirasaki ..... G09G 3/3225 345/211
2011/0122119 A1 * 5/2011 Bae ..... G09G 3/3233 345/211
2011/0227505 A1 * 9/2011 Park ..... H05B 33/0896 315/297
2012/0299978 A1 * 11/2012 Chaji ..... G09G 3/3291 345/690
2014/0252988 A1 * 9/2014 Azizi ..... H05B 33/0848 315/307

FOREIGN PATENT DOCUMENTS

JP 2009-080252 4/2009
JP 2009-168927 7/2009
JP 2009-244654 10/2009

* cited by examiner

Vgs=Vdata-Vref-Vth

ELECTRO-OPTICAL DEVICE

CROSS-REFERENCE TO RELATED APPLICATION

Japanese Patent Application No. 2013-174761, filed on Aug. 26, 2013, and entitled, "Electro-Optical Device," is incorporated by reference herein in its entirety.

BACKGROUND

1. Field

One or more embodiments described herein relate to an optoelectronic device.

2. Description of the Related Art

An optoelectronic device has been developed to generate images using organic electroluminance light-emitting diodes (OLEDs). The OLEDs emit light according to the intensity of supplied current. To display a full color image, the amount of current supplied to each OLED is controlled for each of a plurality of colors for each pixel. This amount of current corresponds to gray scale data of an image signal.

Structurally, an OLED is formed to include a light-emitting layer. Because the light-emitting layer is made of an organic compound, its time degradation is greater than that of a light-emitting element formed of a typical silicon semiconductor. The current-luminance characteristic of the OLED varies due to this time degradation. These effects may damage or adversely affect the reproduction of an original image. For example, the time degradation may cause each OLED in the optoelectronic device to emit light with a different luminance or at different intensities for the same current value.

SUMMARY

In accordance with one embodiment, an optoelectronic device includes a first transistor electrically connected between a power supply and an electrode of at least one light-emitting element, the first transistor having a gate to receive a gray scale voltage, and to supply the at least one light-emitting element with a driving current corresponding to the gray scale voltage; a second transistor having a gate electrically connected to an electrode of the at least one light-emitting element and a source or drain electrically connected to a circuit including a voltmeter; and a control circuit to read a measurement value of the voltmeter when the gate of the first transistor receives the gray scale voltage, and to correct a next gray scale voltage applied to the gate of the first transistor based on the measurement value.

The device may include a third transistor to selectively apply a reference voltage to the electrode of the at least one light-emitting element, wherein the control circuit: reads a measurement value of the voltmeter as a first measurement value, with the third transistor controlled such that the reference voltage is applied to the electrode of the at least one light-emitting element, reads a measurement value of the voltmeter as a second measurement value, with the third transistor controlled such that the reference voltage is not applied to the electrode of the at least one light-emitting element and when the gate of the first transistor receives the gray scale voltage, and corrects the next gray scale voltage to be applied to the gate of the first transistor based on a difference between the first measurement value and the second measurement value.

A reset voltage may be selectively applied to the gate of the first transistor, and the control circuit may read the first measurement value when the reset voltage is applied to the gate of the first transistor. The at least one light-emitting element may include a plurality of light-emitting elements, and wherein the first and second transistors are provided for each of the light-emitting elements.

The reset voltage, the gray scale voltage, and the reference voltage may be supplied from the control circuit via a common data line. The circuit including the voltmeter may be electrically connected to the second transistor via the data line.

The device may include a first scan transistor and a second scan transistor, wherein the first scan transistor is controlled by the control circuit and connects the data line and the gate of the first transistor, and wherein the second scan transistor is controlled by the control circuit and opens and shuts the circuit including the voltmeter. The device may include a capacitor electrically connected between the gate and a source of the first transistor to hold the reset voltage or the gray scale voltage.

The control circuit may use, as a reference value, a voltage generated at the electrode of the at least one light-emitting element before deterioration occurs as a result of current that the first transistor supplies to the at least one light-emitting element when the gate of the first transistor receives the grays scale voltage, and corrects the next gray scale voltage applied to the gate of the first transistor based on a deviation of the difference from the reference value.

In accordance with another embodiment, an optoelectronic device includes a first transistor electrically connected between a power supply and an electrode of a light-emitting element, the first transistor having a gate to receive a gray scale voltage or a reset voltage, the first transistor to supply the light-emitting element with a driving current corresponding to the gray scale voltage when the gate of the first transistor receives the gray scale voltage, and to turn off when the gate of the first transistor receives the reset voltage; a second transistor having a gate electrically connected to the electrode of the light-emitting element and a source or drain electrically connected to a circuit including a voltmeter and a power; and a control circuit to read a measurement value of the voltmeter as a temperature measurement value when the gate of the first transistor receives the reset voltage, to read a measurement value of the voltmeter as a voltage measurement value when the gate of the first transistor receives the gray scale voltage, to correct the voltage measurement value according to the temperature measurement value, and to correct a next gray scale voltage applied to the gate of the first transistor based on the voltage measurement.

The device may include a third transistor to selectively apply a reference voltage to the electrode of the light-emitting element, wherein the control circuit is to: read a measurement value of the voltmeter as a third measurement value with the reset voltage applied to the gate of the first transistor, apply the reset voltage to the gate of the first transistor and to read a measurement value of the voltmeter as a first measurement value with the third transistor controlled so that the reference voltage is applied to the electrode of the light-emitting element, apply the gray scale voltage to the gate of the first transistor and to read a measurement value of the voltmeter as a second measurement value with the third transistor controlled so that the reference voltage is not applied to the electrode of the light-emitting element, and calculate a difference between the first and second measurement values, correct the difference based on the third measurement value, and correct the next gray scale voltage to be applied to the gate of the first transistor based on the corrected difference.

The control circuit may use, as a reference value, a value obtained by shifting a voltage based on the third measurement value, the voltage generated at the electrode of the light-emitting element before deterioration due to current that the first transistor supplies to the light-emitting element when the first transistor receives the gray scale voltage, and correct the next gray scale voltage applied to the gate of the first transistor based on a deviation of the difference from the reference value.

In accordance with another embodiment, an apparatus includes an interface; and a controller coupled to the interface and to (a) read a measurement value of a voltmeter connected to a second transistor of a pixel driving circuit, the second transistor connected to a light-emitting element and the controller to read the measurement when a gate of a first transistor of the pixel driving circuit receives a gray scale voltage, the first transistor electrically connected between a power supply and the light-emitting element, and (b) to correct a subsequent gray scale voltage to be applied to the gate of the first transistor based on the measurement value.

The controller may read a measurement value of the voltmeter as a first measurement value, the first measurement value to be read when a reference voltage is applied to the light-emitting element, and read a measurement value of the voltmeter as a second measurement value, the second measurement value to be read when the reference voltage is not applied to the light-emitting element and when the gate of the first transistor receives the gray scale voltage, and correct the next gray scale voltage to be applied to the gate of the first transistor based on a difference between the first measurement value and the second measurement value.

The controller may read the first measurement value when a reset voltage is applied to the gate of the first transistor. The controller may supply the reset voltage, the gray scale voltage, and the reference voltage through a same line. The same line may be a data line. The voltmeter may be electrically connected to the second transistor via the same data line.

The controller may control a first scan transistor which connects the data line and the gate of the first transistor, and control a second scan transistor which opens and shuts a circuit including the voltmeter. The controller may determine a reference value based on a voltage generated at an electrode of the light-emitting element before deterioration occurs, the deterioration to occur as a result of current the first transistor is to supply to the light-emitting element when the gate of the first transistor receives the grays scale voltage, and correct the subsequent gray scale voltage applied to the gate of the first transistor based on a deviation of the difference from the reference value.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
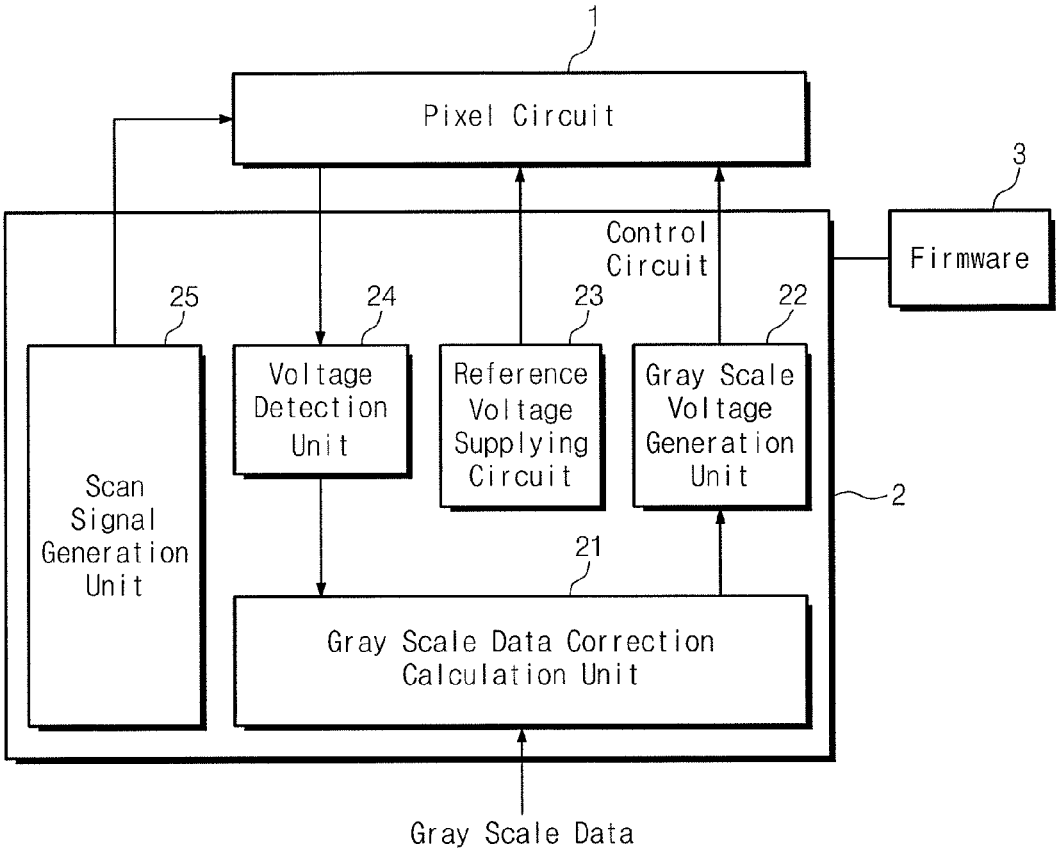
FIG. 1 illustrates a first embodiment of an optoelectronic device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Figure 2:
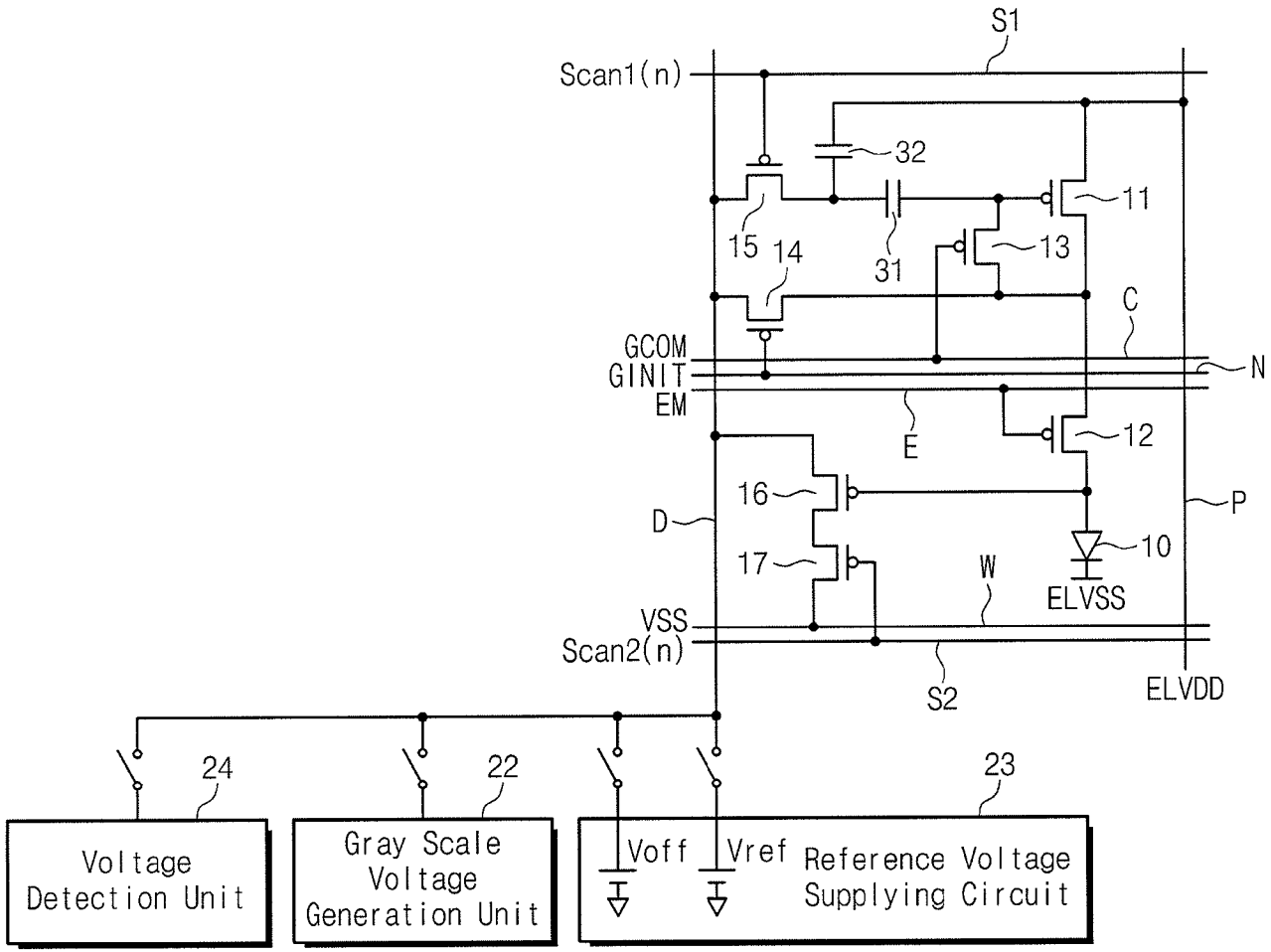
FIG. 2 illustrates an embodiment of a pixel circuit.

FIG. 1 illustrates a first embodiment of an optoelectronic device, and FIG. 2 illustrates a pixel circuit 1 for driving the optoelectronic device. The optoelectronic device includes a predetermined number of (e.g., three) OLEDs per pixel. The three OLEDs of each pixel emit different color light (e.g., red, green, and blue) for expressing a full color from a display panel. The pixel circuit 1 in FIG. 1 includes a set of circuits for driving respective OLEDs. The driving circuits of the OLEDs may be disposed in a matrix to form the display panel.

As illustrated in FIG. 2, a data line D is connected in common to driving circuits of OLEDs 10 arranged in a column direction. A first scan line S1, a second scan line S2, a compensation transistor driving line C, an initialization transistor driving line N, and a light-emitting switch driving line E are connected in common to driving circuits of OLEDs 10 arranged in a row direction. A first power line P is connected to the driving circuits of the OLEDs 10 and is supplied with a constant voltage ELVDD. The voltage ELVDD is a predetermined voltage, e.g., one sufficiently higher than a ground potential, supplied from a power supply circuit. A second power line W connected to the driving circuits of the OLEDs 10 is connected to a voltage VSS. The voltage VSS is a predetermined voltage, e.g., one sufficiently lower than the ground potential. A cathode of each OLED 10 is connected to a reference potential, e.g., ground.

As illustrated in FIG. 1, the optoelectronic device includes the pixel circuit 1 and a control circuit 2. The control circuit 2 receives an image signal which includes gray scale data of different colors supplied from an external source, supplies a gray scale voltage for setting the luminance of each OLED 10 to the data line D, and supplies a scan signal to the first and second scan lines S1 and S2 at the same time. The control circuit 2 is coupled to an interface, which, for example, may correspond to one or more outputs of a chip including the control circuit or which corresponds to signal lines connecting the control circuit 2 to the pixel circuit 1.

The control circuit 2 may include a processor (e.g., a computer, controller, or other signal processing device) that operates based on firmware in a storage medium 3. The control circuit controls functions of a gray scale data correction calculation unit 21, a gray scale data generation unit 22, a reference voltage supplying circuit 23, a voltage detection unit 24, and a scan signal generation unit 25 in conjunction with hardware of the control circuit 2, for example, except for the processor, guided by the firmware.

The reference voltage supplying unit 23 provides each data line D with a reset voltage Voff (Voff ELVDD) and a reference voltage Vref for voltage measurement (Vth_el>Vref ELVDD), where Vth_el is the light-emitting threshold voltage of an OLED. The reset voltage Voff is used to reset a driving circuit of an OLED 10 connected to the data line D.

The gray scale voltage generation unit 22 generates a gray scale voltage to be set for each OLED 10 based on gray scale data of different colors of each pixel. The gray scale voltage is corrected by the gray scale data correction calculation unit 21. Also, the gray scale voltage generation unit 22 supplies the gray scale voltage Vdata to a corresponding data line D sequentially from the OLED 10 of a first row in every column.

The scan signal generation unit 25 supplies the first scan line S1 with a first scan signal Scan1 for appointing driving circuits of OLEDs 10 to be set with a gray scale voltage Vdata that the gray scale voltage generation unit 22 sequentially supplies to each data line D. The scan signal generation unit 25 provides the second scan line S2 with a second scan signal Scan2 for appointing a row of OLEDs 10 where a voltage is to be measured. Also, the scan signal generation unit 25 supplies a compensation transistor driving signal GCOM to each compensation transistor driving line C, an initialization transistor driving signal GINT to each initialization transistor driving line N, and a light-emitting switch driving signal EM to each light-emitting switch driving line E.

Figure 3:
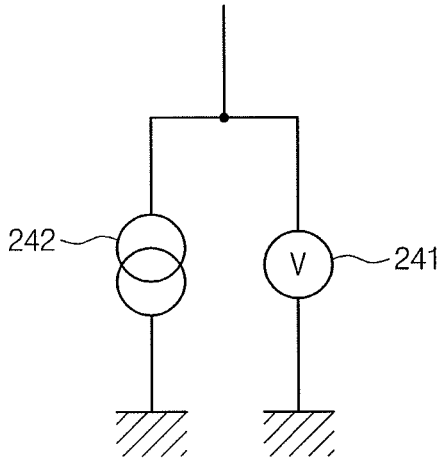
FIG. 3 illustrates an embodiment of a voltage detection unit.

The voltage detection unit 24 measures an anode voltage of each of OLEDs 10 of a row appointed by the second scan signal Scan2, through each data line D. The voltage detection unit 24 reads the measured anode voltage, for example, from a voltmeter connected as illustrated in FIGS. 2 and 3. For example, each data line D diverges as illustrated in FIG. 2. A voltmeter 241 for the voltage detection circuit 24 is connected in parallel with an output terminal for the gray scale voltage generation unit 22 and an output terminal for the reference voltage supplying circuit 23. The voltmeter 241 is connected in parallel with a constant current source 242.

The gray scale data correction calculation unit 21 predicts a degree of aged deterioration based on an anode voltage measured by the voltage detection unit 24 when a reference voltage is applied and an anode voltage measured by the voltage detection unit 24 when a gray scale voltage is applied. This measuring operation may be performed for each of the OLEDs 10. The degree of aged deterioration may correspond to the degree to which the luminance of the OLED 10 deviates from gray scale data when a gray scale voltage is applied.

Also, the gray scale data correction calculation unit 21 corrects (or feeds back) gray scale data to thereby correct the deviation based on the degree of aged deterioration. The gray scale data correction calculation unit 21 provides the gray scale voltage generation unit 22 with the corrected gray scale data.

In accordance with the first embodiment, the pixel circuit 1 includes a driving transistor 11 and a light-emitting switch transistor 12 connected in series between the power line P and an anode of the OLED 10. A light-emitting switch driving line E is electrically connected to a gate of the light-emitting switch transistor 12. A compensation transistor 13 is electrically connected between a gate and a drain of the driving transistor 11, and a gate of the compensation transistor is electrically connected to a compensation transistor driving line C.

An initialization transistor 14 is electrically connected between the data line D and a connection node located between the drain of the driving transistor 11 and a source of the light-emitting switch transistor 12. A gate of the initialization transistor 14 is electrically connected to the initialization transistor driving line N.

A first capacitor 31 and a second capacitor 32 are connected between a source and a gate of the driving transistor 11 from a gate side. A first scan transistor 15 is electrically connected to the data line D and a connection node between the capacitors 31 and 32. A gate of the first scan transistor 15 is electrically connected to a first scan line S1.

A sensing transistor 16 and a second scan transistor 17 are electrically connected in series between the data line D and the second power line W from a data line (D) side. The gate of the sensing transistor 16 is electrically connected to the anode of the OLED 10. The gate of the second scan transistor 17 is electrically connected to a second scan line S2. In this embodiment, transistors 11 to 17 are p-channel MOSFETs.

Figure 4:
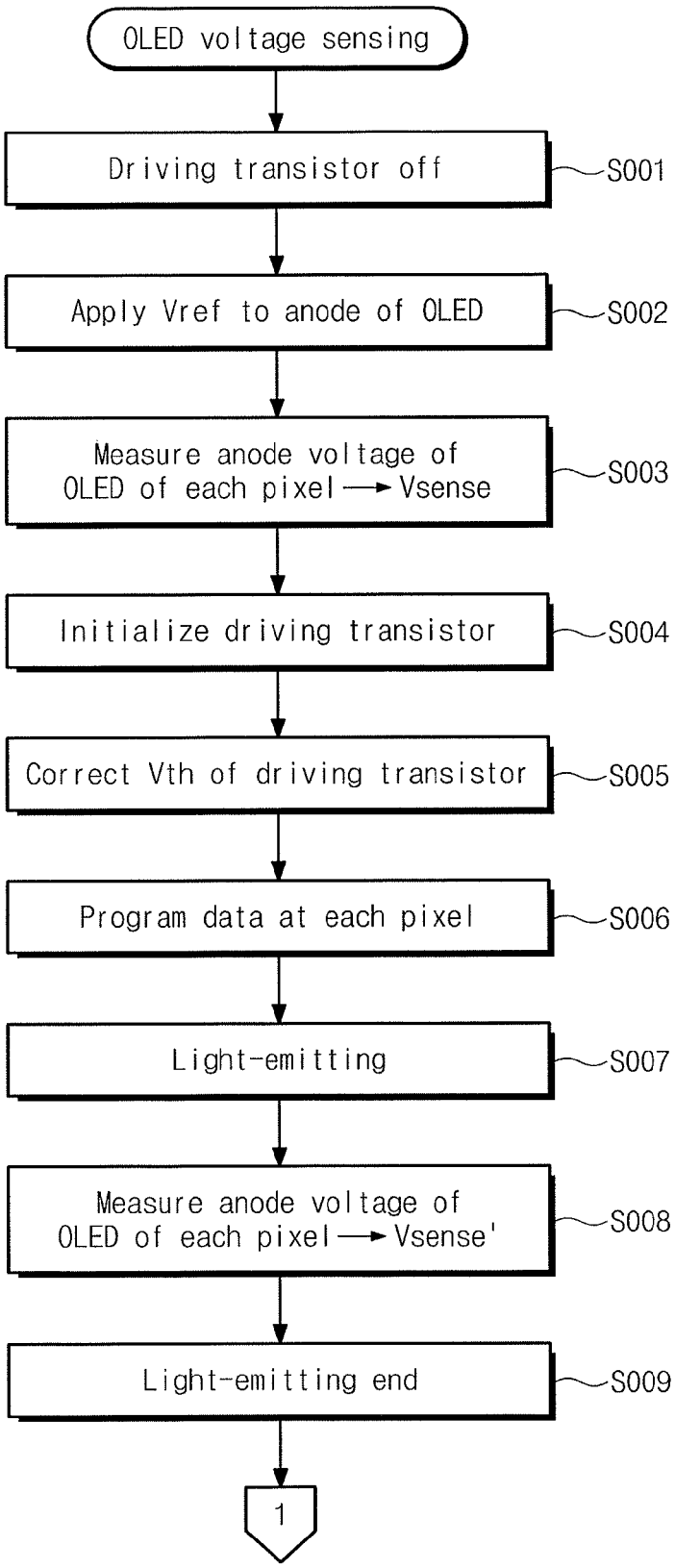
FIG. 4 illustrates an embodiment of a control method for the pixel circuit.
Figure 5:
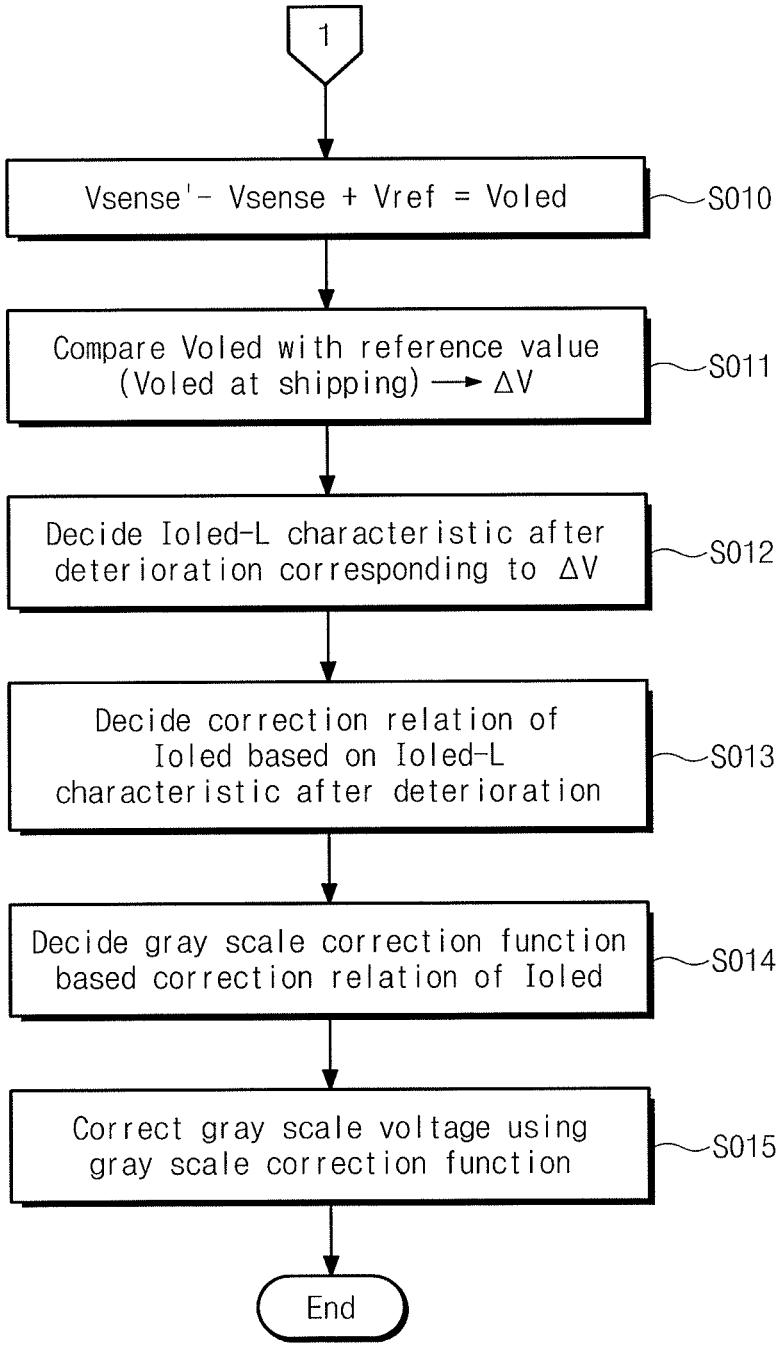
FIG. 5 illustrates additional operations of the method embodiment.
Figure 6:
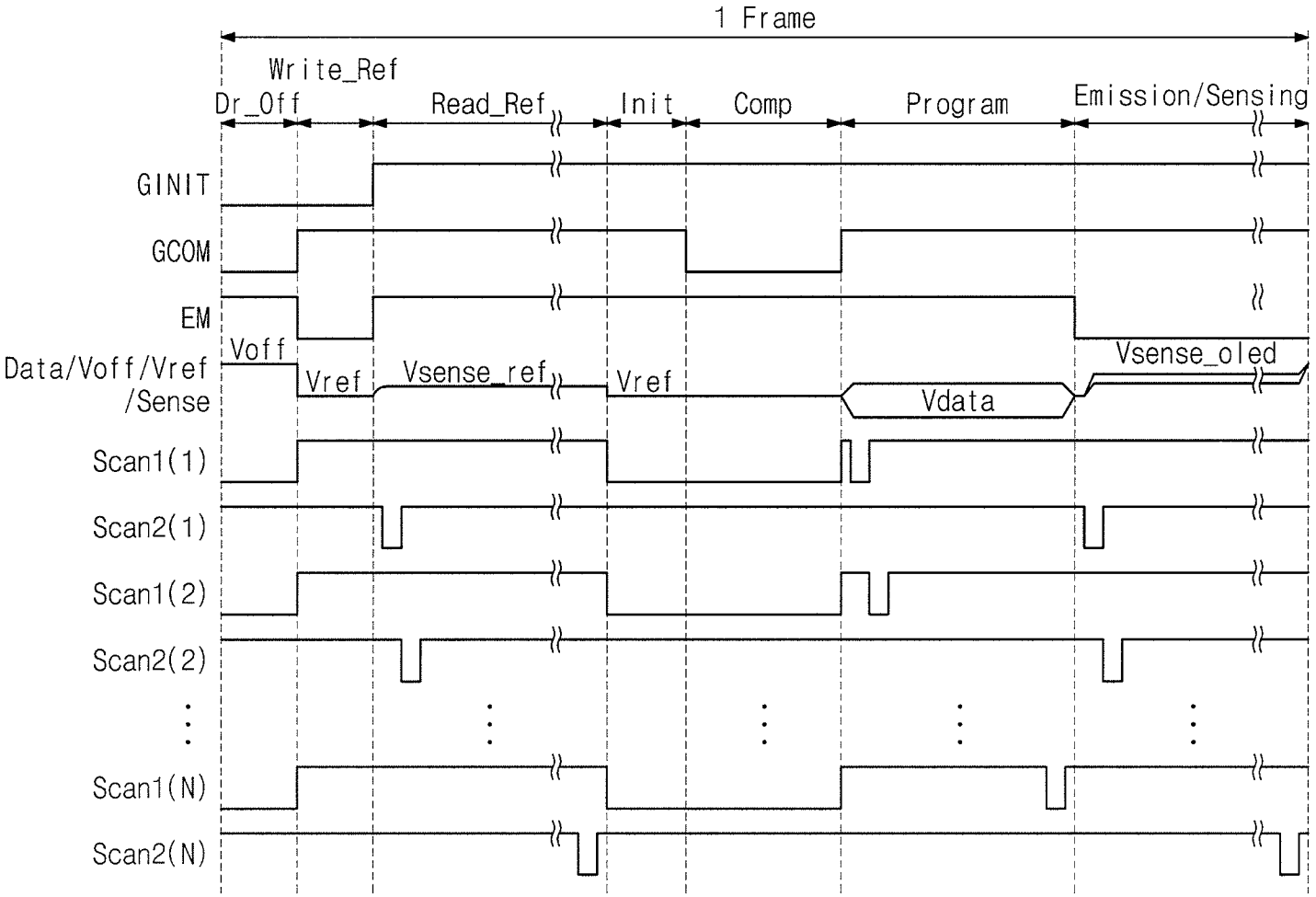
FIG. 6 illustrates an example of control signals for the pixel circuit.

FIGS. 4 and 5 illustrate operations in one embodiment of a method for controlling the pixel driving circuit of each OLED 10 using the control circuit 2. FIG. 6 is a timing diagram for controlling the pixel driving circuit, and FIGS. 7 to 15 illustrate operations of the pixel driving circuit performed by the method embodiment based on the timing diagram.

The operations in FIGS. 4 and 5 may be performed whenever an image of one frame is displayed on the display panel of the optoelectronic device, and/or may be performed only when starting and/or shutting down the display panel and/or reducing the display panel to a lower operating mode. When displaying the image of one frame, the operations in FIGS. 4 and 5 may be executed with respect to a predetermined number (e.g., all) rows of OLEDs 10. The predetermined number of rows may be all rows or less than all rows. In one embodiment, the operations in FIGS. 4 and 5 may be executed in such a way that a row corresponding to a target is shifted by one row or another number of rows.

Figure 7:
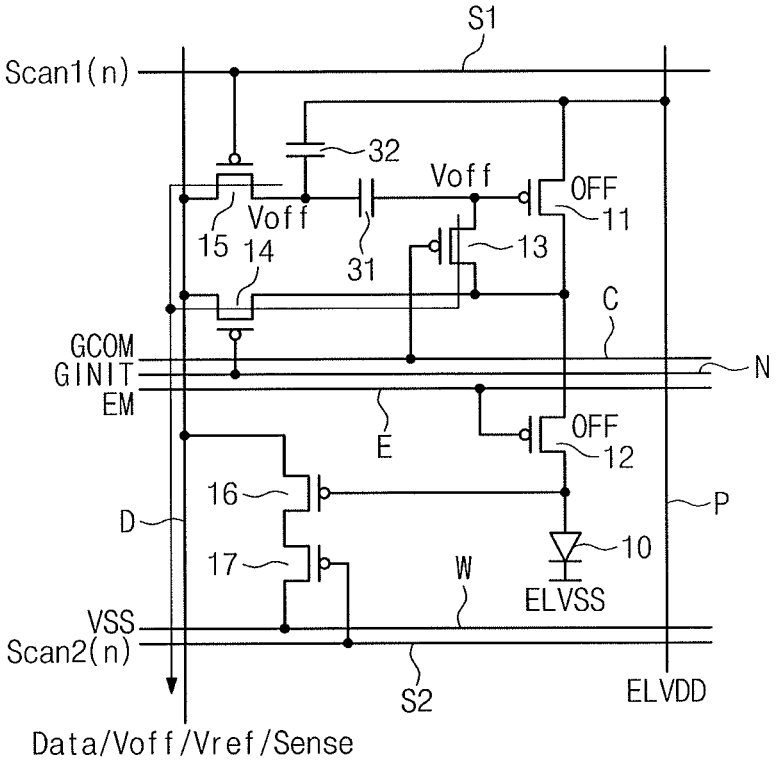
FIG. 7 illustrates an example of a driving state of the pixel circuit.
Figure 8:
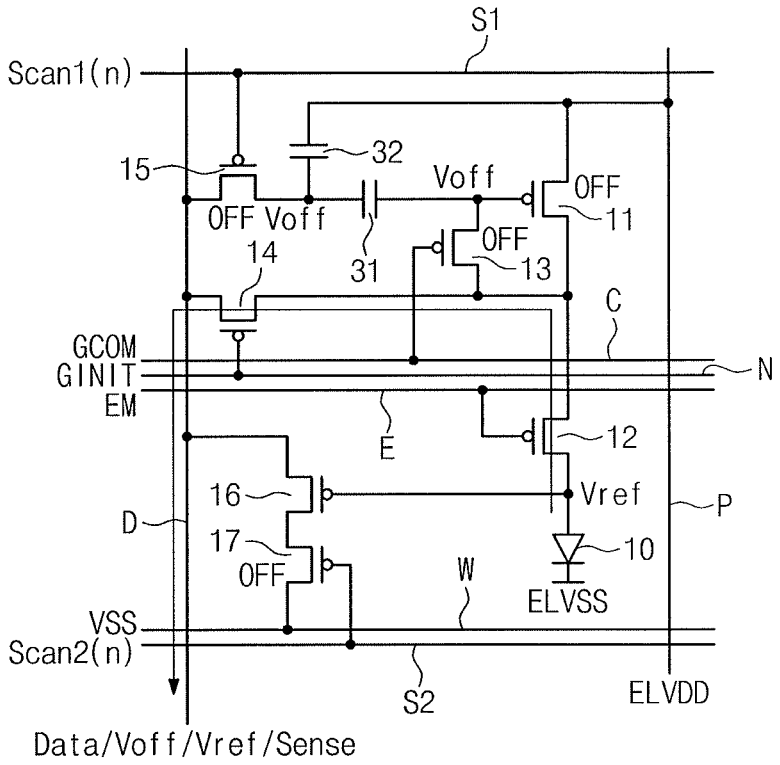
FIG. 8 illustrates an example of another driving state of the pixel circuit.

When the procedure starts, the control circuit 2 turns off the driving transistors 11 of the pixel driving circuits of all OLEDs 10 (operation S001), as illustrated, for example, in FIG. 7. This may be achieved by applying a reset voltage Voff to all (or a predetermined number of) data lines D under the condition that a first scan signal Scan1 is set to a low value L (e.g., a first scan transistor 15 is turned on), a compensation transistor driving signal GCOM is set to L (e.g., a compensation transistor 13 is turned on), an initialization transistor driving signal GINT is set to L (e.g., an initialization transistor 14 is turned on), a light-emitting switch driving signal EM is set to a high value H (e.g., a light-emitting switch transistor 12 is turned off), and a second scan signal is set to H (e.g., a second scan transistor 17 is turned off). The operation S001 may be performed, for example, to prevent the power of a reference voltage and the power of power supply voltage ELVDD from being shorted in subsequent operation, for example, operation S002 as illustrated in FIG. 8.

In operation S002, the control circuit 2 maintains a reset voltage coupled to a second capacitor 32 at voltage Voff, so that the driving transistor 11 remains in a turned off state. The control circuit 2 may apply a reference voltage Vref to the anodes of all OLEDs 10 of a target row, for example, as illustrated in FIG. 8. This may be achieved by setting the potential of the first scan signal Scan1 to H (e.g., the first scan transistor 15 is turned off), the potential of the compensation transistor driving signal GCOM to H (e.g., the compensation transistor 13 is turned off), and the potential of the light-emitting switch driving signal EM to L (e.g., the light-emitting switch transistor 12 is turned on) and switching the potentials of all data lines D to the reference voltage Vref. As a result, the OLED 10 does not emit light at this point in time.

Figure 9:
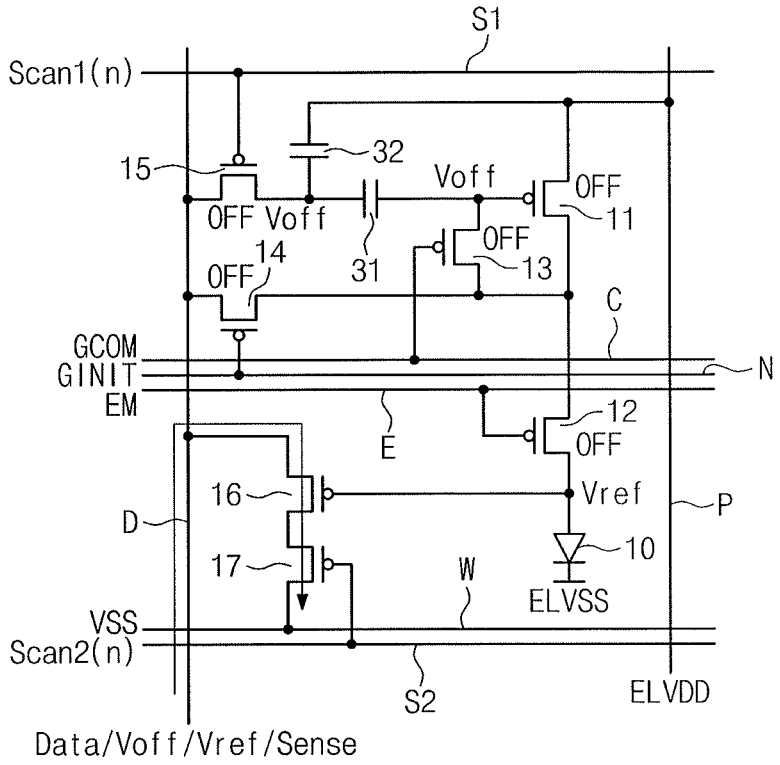
FIG. 9 illustrates an example of another driving state of the pixel circuit.

In operation S003, the control circuit 2 controls the reference voltage Vref to be held in the internal capacitance of all the OLEDs 10 of the target row, for example, as illustrated in FIG. 9. This may be achieved by setting the potential of the initialization transistor driving signal GINT to H (e.g., the initialization transistor 14 is turned off), the potential of the light-emitting switch driving signal EM to H (e.g., the light-emitting switch transistor 12 is turned off), and the potential of a second scan signal Scan2 to L (e.g., a second scan transistor 17 is turned on), and by simultaneously separating the reference voltage Vref from all the data lines D, to connect each data line D to the voltage detection unit 24.

As a result, current flows from a constant current source 242 to VSS through a sensing transistor 16 and the second scan transistor 17. However, a current value I is constant regardless of source-to-drain impedance corresponding to the reference voltage Vref applied to a gate of the sensing transistor 16. Thus, a voltage value Vsense that a voltmeter 241 measures may be expressed by the following equation.

$$V_{SENSE} = V_{ref} + \left[ Vth + \sqrt{\frac{2I}{\beta}} \right] \tag{1}$$

In Equation 1, Vth is a threshold value of a gate-source voltage of the sensing transistor 16, I is a current value of the constant current source 242, and β is a coefficient representing a characteristic of the sensing transistor 16. This voltage value Vsense may correspond to a first measurement value.

Figure 10:
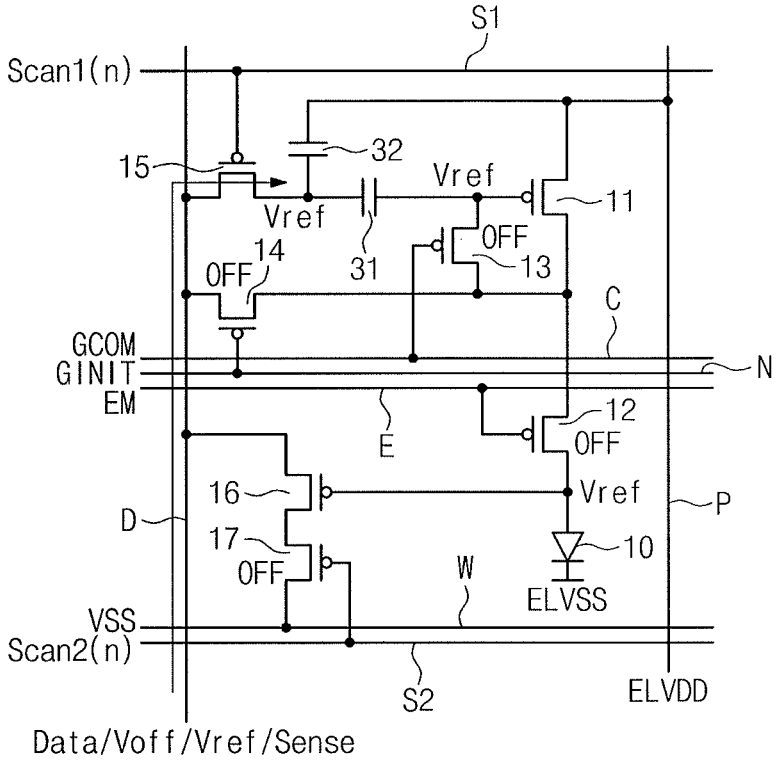
FIG. 10 illustrates an example of another driving state of the pixel circuit.
Figure 11:
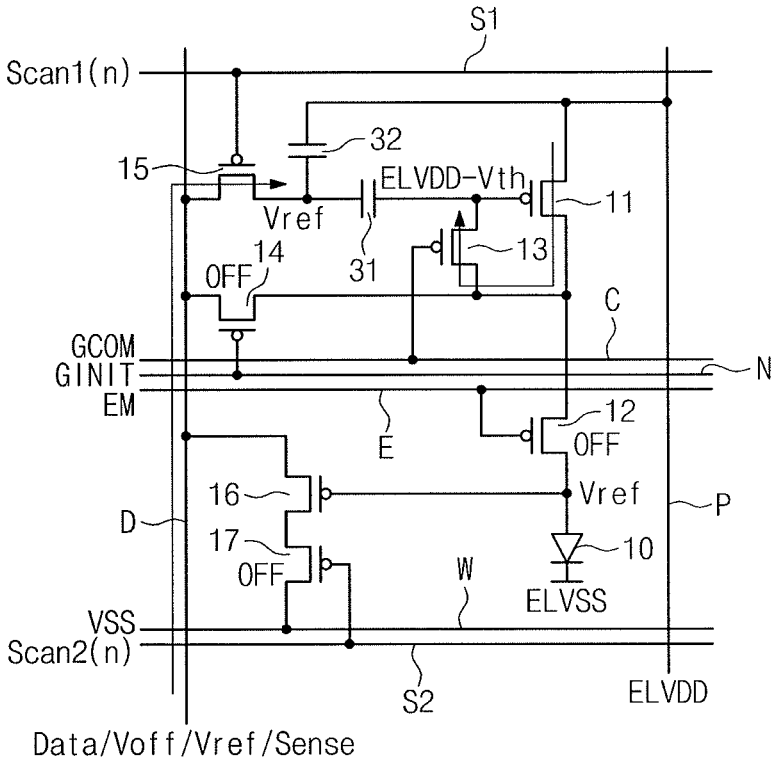
FIG. 11 illustrates an example of another driving state of the pixel circuit.

In operation S004, the control circuit 2 initializes the driving transistors 11 of the driving circuits of all the OLEDs 10 of the target row. This may be accomplished by switching a potential of the first scan signal Scan1 to L (e.g., the first scan transistor 15 is turned on) and the potential of the second scan signal Scan2 to H (e.g., the second scan transistor 17 is turned off) and applying the reference voltage Vref to all the data lines D, for example, as illustrated in FIG. 10. This operation may sufficiently lower the gate-source voltage Vgs of the driving transistor 11 so that the driving transistor 11 is turned on, in order to allow the threshold voltage of the driving transistor 11 to be compensated in operation S005, for example, as illustrated in FIG. 11. Thus, the voltage stored in the second capacitor 32 becomes the reference voltage Vref. This reference voltage Vref is applied to the gate of the driving transistor 11, and thus the driving transistor 11 is turned on.

In operation S005, the control circuit 2 switches the potential of the compensation transistor driving signal GCOM to L (e.g., the compensation transistor 13 is turned on) to generate current passing through the driving transistor 11 and the compensation transistor 13 from the first power line P, for example, as illustrated in FIG. 11. At this time, the gate voltages of the driving transistors 11 of the pixel driving circuits of all the OLEDs 10 of a target row increase from the reference voltage Vref and converges on (ELVDD−Vth), where Vth represents the threshold value of the gate-source voltage of the driving transistor 11. A resultant voltage is stored in the first capacitor 31; that is, the driving transistor 11 is diode connected, so a threshold voltage Vth is programmed.

Figure 12:
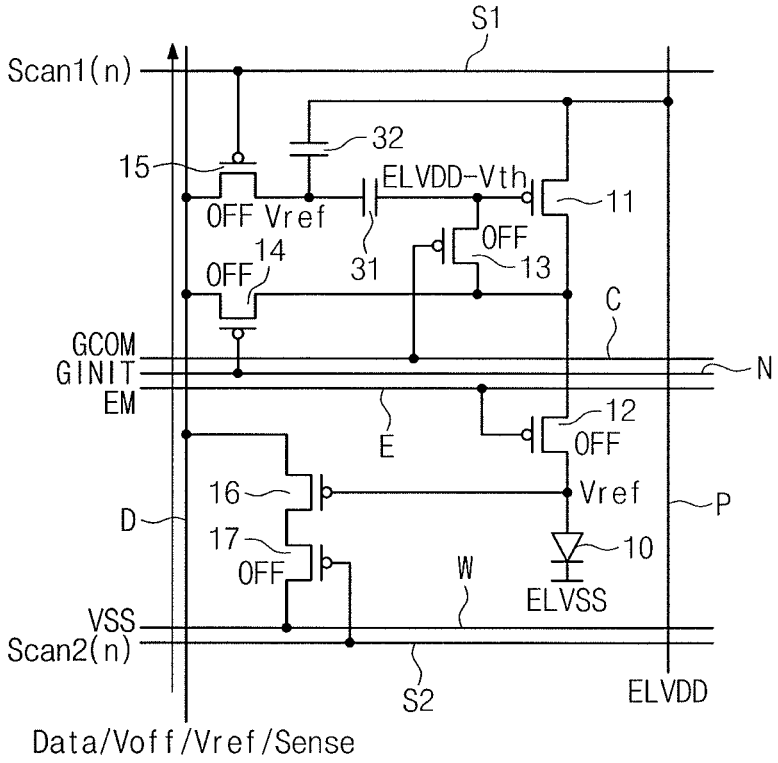
FIG. 12 illustrates an example of another driving state of the pixel circuit.
Figure 13:
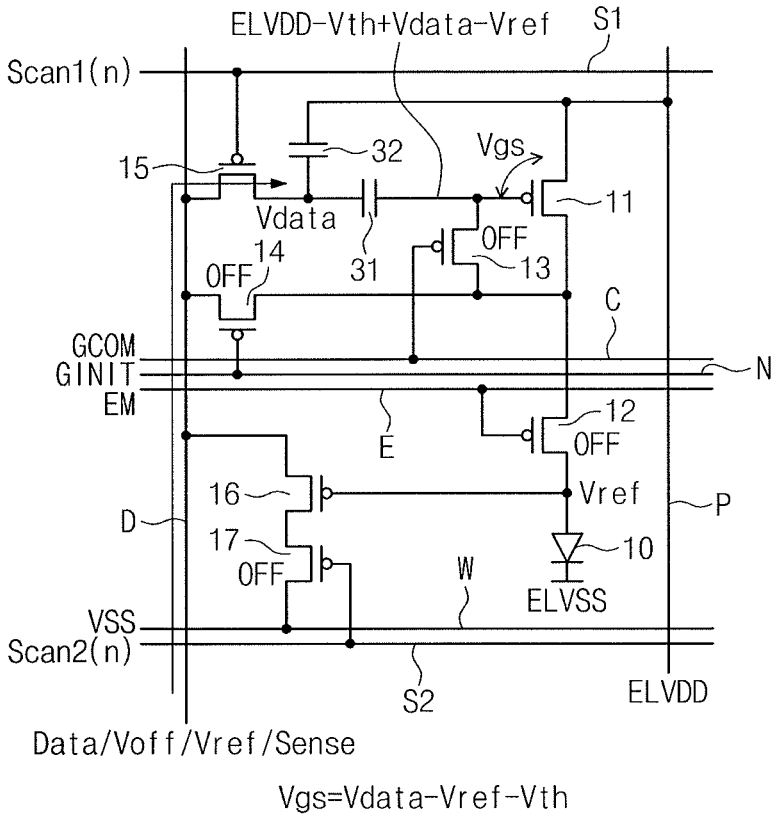
FIG. 13 illustrates an example of another driving state of the pixel circuit.

In operation S006, the control circuit 2 switches the potential of the compensation transistor driving signal GCOM to H (e.g., the compensation transistor 13 is turned off) and a first scan signal (Scan1 to N), except a first row, to H (e.g., the first scan transistor 15 is turned off), for example, as illustrated in FIG. 12). Simultaneously, the control circuit 2 applies a gray scale voltage Vdata for the OLEDs 10 of the first row to a data line D, for example, as illustrated in FIG. 13. Afterwards, a row where the first scan signal (Scan1 to N) is at L is shifted by one row, and a gray scale voltage Vdata for the OLEDs 10 of each row is sequentially applied to the data line D in synchronization with the shift.

As illustrated in FIG. 13, in the driving circuit of the OLED 10 of a row where the first scan signal (Scan1 to N) is switched into L (e.g., the first scan transistor 15 is turned on), the gray scale voltage Vdata is applied to a connection node between the first capacitor 31 and the second capacitor 32 via the data line D, and the potential of the connection node increases from Vref to Vdata. With this bias condition, the gate voltage of the driving transistor 11 is shifted by an increment (Vdata−Vref) of the potential of the connection node, as a result of capacitive coupling through the first capacitor 31. The gate voltage, thus, becomes (ELVDD−Vth+Vdata−Vref). That is, the gate-source voltage Vgs of the driving transistor 11 becomes (Vgs=Vdata−Vref−Vth).

As illustrated in FIG. 12, in the driving circuit of the OLED 10 of a row where the first scan signal (Scan1 to N) is switched to H (e.g., the first scan transistor 15 is turned off) after a gray scale voltage is programmed, the value of Vgs is maintained because the first scan transistor 15 is turned off and the connection node between the first and second capacitors 31 and 32 is floated. Programming the gray scale voltage is therefore completed.

In one embodiment, the value of the gray scale voltage may be obtained by multiplying a predetermined conversion coefficient and a luminance value of gray scale data input to the control circuit 2, and then executing a gray scale correction function. Because a coefficient of the gray scale correction function is 1 at a point in time when the method in FIG. 4 is first executed, correction on the gray scale voltage is not performed.

Also, when the method in FIGS. 4 and 5 is performed during start-up or shut-down, because gray scale data (provided to the control circuit 2 from an external source) does not exist, the gray scale voltage may be calculated based on gray scale data (e.g., data for Voled measurement) of a predetermined luminance value. When operation S006 is completed, all the data lines D are separated from a terminal of the gray scale voltage generation unit 22.

Figure 14:
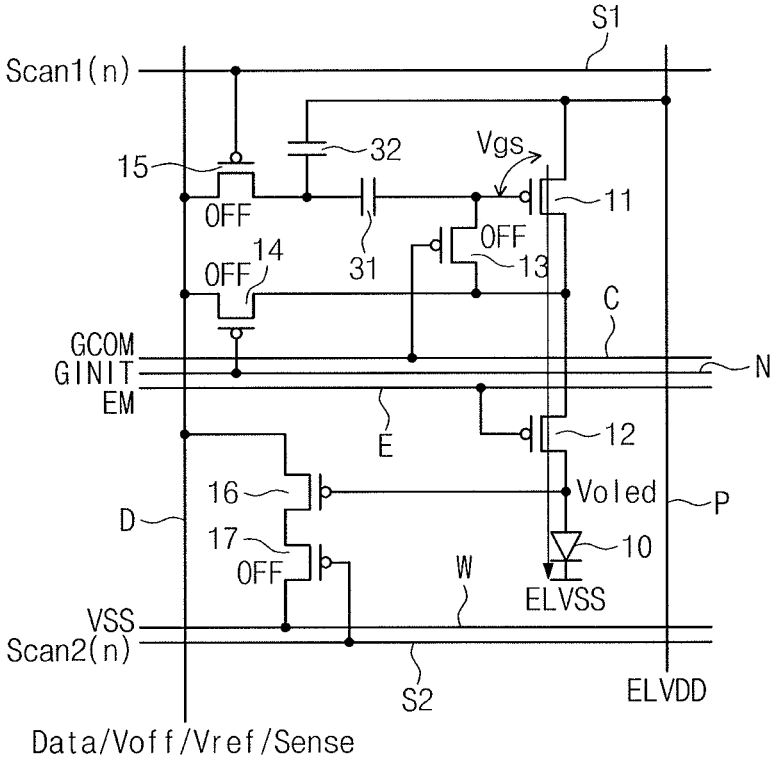
FIG. 14 illustrates an example of another driving state of the pixel circuit.

In operation S007, the control circuit 2 switches the potentials of light-emitting switch driving signals EM of all rows to L (e.g., the light-emitting switch transistor 12 is turned on) and provides all the OLEDs 10 with a current proportional to the gray scale voltage Vgs (Vdata−Vref−Vth) programmed at the driving transistors 11 of the driving circuits corresponding to the OLEDs 10, as illustrated in FIG. 14. As a result, each OLED 10 emits light with a luminance which corresponds to a value of supplied current based on its current-luminance characteristic. At this time, the voltage of the anode of the each OLED 10 is a measurement target voltage Voled.

Figure 15:
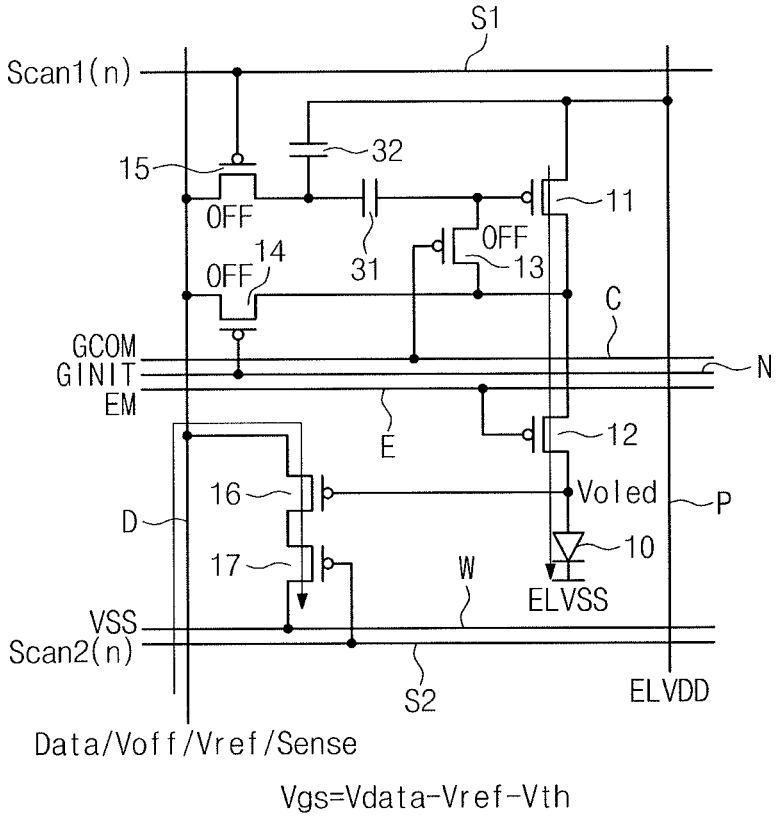
FIG. 15 illustrates an example of another driving state of the pixel circuit.

In operation S008, the control circuit 2 switches the potential of the second scan signal Scan2 to L (e.g., the second scan transistor 17 is turned on), for example, as illustrated in FIG. 15. As a result, current flows from the constant current source 242 to a power of VSS via the sensing transistor 16 and the second scan transistor 17. However, because a current value I is constant regardless of the source-drain impedance corresponding to the measurement target voltage Voled applied to the gate of the sensing transistor 16, the voltage value Vsense' that the voltmeter measures may be expressed by the following equation.

$$V'_{SENSE} = V_{oled} + \left[ Vth + \sqrt{\frac{2I}{\beta}} \right] \quad (2)$$

In Equation 2, Vth is the threshold value of the gate-source voltage of the sensing transistor 16, I is the current value of the constant current source 242, and β is the coefficient representing a characteristic of the sensing transistor 16. This voltage value Vsense' may correspond to a second measurement value.

In operation S009, the control circuit 2 terminates light-emission from all the OLEDs 10. This is achieved by setting the first scan signal Scan1 to L (e.g., the first scan transistor 15 is turned on), the compensation transistor driving signal GCOM to L (e.g., the compensation transistor 13 is turned on), the initialization transistor driving signal GINT to L (e.g., the initialization transistor 14 is turned on), the light-emitting switch driving signal EM to H (e.g., the light-emitting switch transistor 12 is turned off), and the second scan signal Scan2 to H (e.g., the second scan transistor 17 is turned off), and applying the reset voltage Voff to all of the data lines D, for example, as illustrated in FIG. 7.

In operation S010, the control circuit 2 calculates Voled according to the following equation.

$$Voled = Vsense' - Vsense + Vref \quad (3)$$

In operation S011, the control circuit 2 compares Voled, calculated in operation S010, with Voled (reference value) at current Ioled1 corresponding to Vgs (Vdata−Vref−Vth), calculated at shipping or manufacture, to determine a difference ΔV between the voltages Voled. Also, The difference ΔV is 0 because time degradation does occur at a point in time when the method of FIGS. 4 and 5 is first executed.

In operation S012, the control circuit 2 determines a current-luminance characteristic after deterioration corresponding to ΔV. Here, a relation exists between a variation in a voltage-current characteristic and a variation in a current-luminance characteristic due to time degradation of the OLED 10. For example, a voltage-current characteristic curve may shift in such a way that a voltage increases, and simultaneously a current-luminance characteristic curve is inclined in such a way that luminance increases. An equation-expressed relation exists between a shift quantity of the former and a variation in a tilt angle of the latter. Thus, the control circuit 2 calculates the variation in a current-luminance characteristic line after deterioration from a tilt angle before deterioration, based on ΔV.

Figure 16:
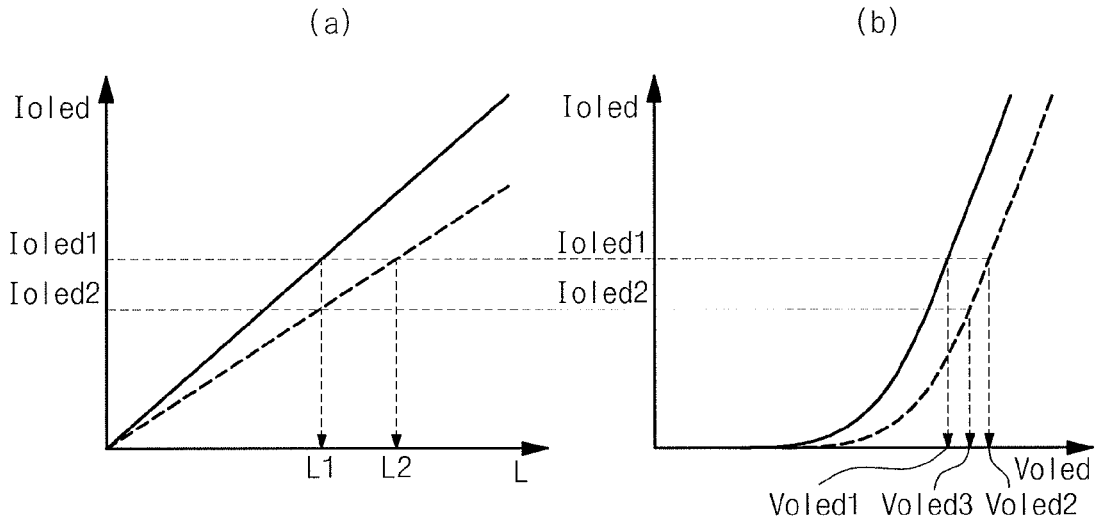
FIG. 16(*a*) illustrates an example of a current-luminance characteristic of an OLED, and FIG. 16(*b*) illustrates an example of a current-voltage characteristic of the OLED.

For example, the solid line in FIG. 16B corresponds to a voltage-current characteristic curve before deterioration, which is shifted up to a location marked by the dotted line due to time degradation. At this time, gray scale correction is not performed with respect to predetermined gray scale data, and the calculated gray scale voltage Vgs (=Vdata−Vref−Vth) without gray scale correction is applied to a gate of the driving transistor 11.

When the driving transistor 11 supplies current Ioled1 corresponding to the calculated gray scale voltage Vgs to the OLED 10, the calculated voltage Voled has Voled1 (reference value) before deterioration and Voled2 after deterioration. Thus, the difference ΔV is (Voled2 −Voled1), which indicates a shift quantity of the voltage-current characteristic curve.

The solid line in FIG. 16A is referred to as a current-luminance characteristic line before deterioration, which is inclined up to a location marked by the dotted line due to the time degradation. At this time, the luminance of the OLED 10 supplied with current Ioled1 is L1 before deterioration and L2 after deterioration. Thus, when current Ioled2 is supplied to the OLED 10 after deterioration, the OLED 10 emits light based on original luminance corresponding to gray scale data. The control circuit 2 may determine the current Ioled2 to be supplied to the driving transistor 11 based on the current-luminance characteristic line, after deterioration, corresponding to ΔV and the original luminance corresponding to gray scale data.

In operation S013, the control circuit 2 determines a correction relation of Ioled, based on a slope difference between current-luminance characteristics before and after deterioration. The correction relation may be expressed as a ratio because a slope difference between current-luminance characteristics indicates deterioration of the OLED 10.

In operation S014, the control circuit 2 determines the above-described gray scale correction function based on the correction relation determined in operation S013.

In operation S015, the control circuit 2 performs a conversion to a gray scale voltage, using the above-described conversion coefficient and correction based on the gray scale correction function determined in operation S014, with respect to gray scale data of a next frame (e.g., all gray scale data received after start-up in the case where the method in FIGS. 4 and 5 is performed only at start-up).

Also, in the case where a target row is one row at a time, gray scale voltage correction is performed with respect to the target row according to the gray scale correction function determining in operation S014 currently executed. For rows other than the target row, if there is a gray scale correction function determined in operation S014 previously executed, the gray scale voltage is corrected based on the gray scale correction function that has been stored in a memory. If not, no correction is performed. After the operation S015 is completed, the method in FIGS. 4 and 5 ends.

In the first embodiment described above, because a line diverging from the anode of the OLED 10 is electrically connected to the gate of the sensing transistor 16, the time for charging the line is inconsequential. Also, the current to be provided to the voltmeter 241 of a voltage detection unit 24 is supplied from a constant current source 242, thereby making it possible to increase the current to the voltmeter 241 to more than that to be provided to the OLED 10. Thus, the voltage is measured within a relatively short time, because a sense line connected to the voltmeter 241 is instantly charged. Also, the measured voltage is not distorted or otherwise changed due to noise.

Modified Embodiment

Figure 17:
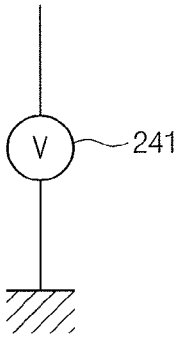
FIG. 17 illustrates a modified embodiment of the voltage detection unit.

The voltage detection unit 24 may be configured to omit the constant current source 242, as illustrated in FIG. 17. In this case, Vss may be set to be sufficiently lower than Vref. Also, Vsense measured in operation S003 (refer to FIG. 9) may be expressed by the Equation 4, and Vsense' measured in operation S008 (refer to FIG. 15) may be expressed by Equation 5.

$$V\text{sense}=V\text{ref}+V\text{th} \quad (4)$$

$$V\text{sense}'=V\text{oled}+V\text{th} \quad (5)$$

From Equations 4 and 5, it is apparent that Vsense and Vsense' do not include an element $\sqrt{2I/\beta}$. Voled may be calculated regardless of I and β by executing Equation 3 in operation S010.

FIGS. 18 to 24 correspond to another embodiment of a method for controlling pixel driving circuits in an optoelectronic device. In the second embodiment, at the time of correction of a gray scale voltage performed due to time degradation of an OLED, a variation in the current-voltage characteristic due to the time degradation may be additionally determined based on a characteristic variation caused by an increase in temperature of the OLED.

Figure 18:
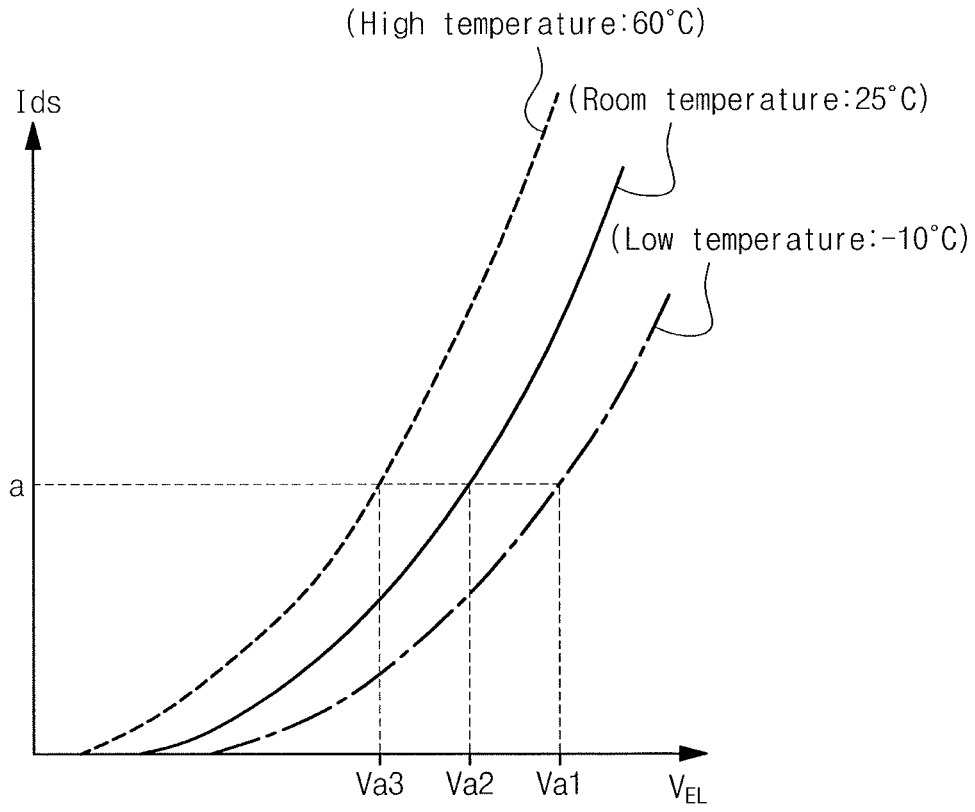
FIG. 18 illustrates an example of temperature dependence of an OLED.
Figure 19:
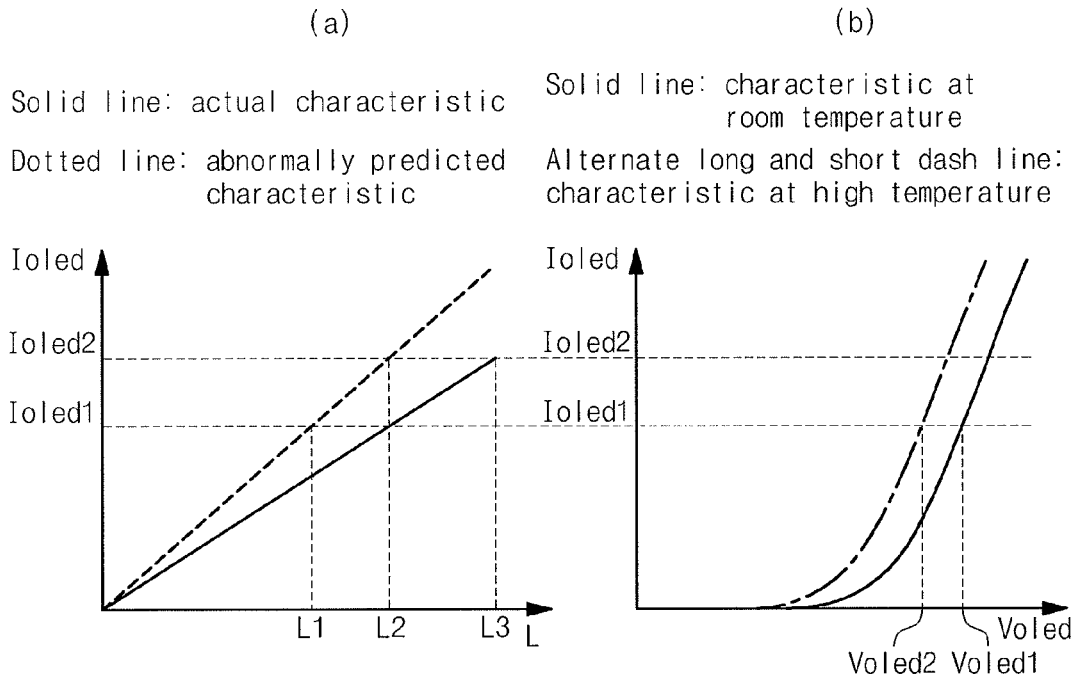
FIG. 19 illustrates features of a second embodiment.

FIG. 18 is a graph showing an example of how the current-voltage characteristic of an OLED 10 may depend on temperature. When the temperature is lower than room temperature, the current-voltage characteristic shifts to a high-voltage side along the voltage axis. When the temperature is higher than the room temperature, the current-voltage characteristic shifts to a low-voltage side along the voltage axis.

The OLED may be easily influence by heat from self-heating and/or by heat from the driving transistor 11. This heat may cause a variation in the current-voltage characteristic due to temperature. Because the anode voltage of the OLED 10 varies according to a component based on the time degradation and a component based on temperature variation, sensing variation in the anode voltage may be problematic. This is because it may be difficult to distinguish between the two components, and thus to perform correction by taking into consideration only the variation in the voltage-current characteristic due to time degradation.

For example, the solid line in FIG. 19B is a voltage-current characteristic curve at a room temperature. When temperature increases, the voltage-current characteristic curve shifts up to a location marked by an alternate long and short dash line. At this time, gray scale correction is not performed with respect to predetermined gray scale data, and a calculated gray scale voltage Vgs (=Vdata−Vref−Vth) without gray scale correction is applied to the gate of the driving transistor 11.

When the driving transistor 11 supplies current Ioled 1 corresponding to the calculated gray scale voltage Vgs to the OLED 10, a calculated voltage Voled is Voled1 at room temperature and Voled2 at high temperature. Because the above-described reference value is Voled1 measured at a room temperature before shipping, a difference ΔV has a negative value if Voled2 is measured at a high temperature.

Under these conditions, the control circuit 2 predicts a current-luminance characteristic line (illustrated by a broken line shown in FIG. 19A) as a current-luminance characteristic after deterioration. This prediction is performed based on a correlation between the current-voltage characteristic and the current-luminance characteristic due to time degradation. However, because the current-luminance characteristic of the OLED 10 does not change with temperature variation, the gray scale voltage is no corrected based on variation in the current-luminance characteristic. Thus, when the control circuit 2 corrects a gray scale voltage according to the current-luminance characteristic line after prediction and supplies Iloed2 to the OLED 10, the luminance of the OLED 10 is changed to L3.

To separate variation in the current-voltage characteristic due to temperature variation and variation in the current-voltage characteristic due to time degradation, the temperature is measured based on leakage current depending on a temperature at turn-off of the driving transistor 11. As a result, variation in the current-luminance characteristic due to temperature variation is obtained. The aforementioned pixel driving method may be performed within an optoelectronic device to form another embodiment.

Figure 20:
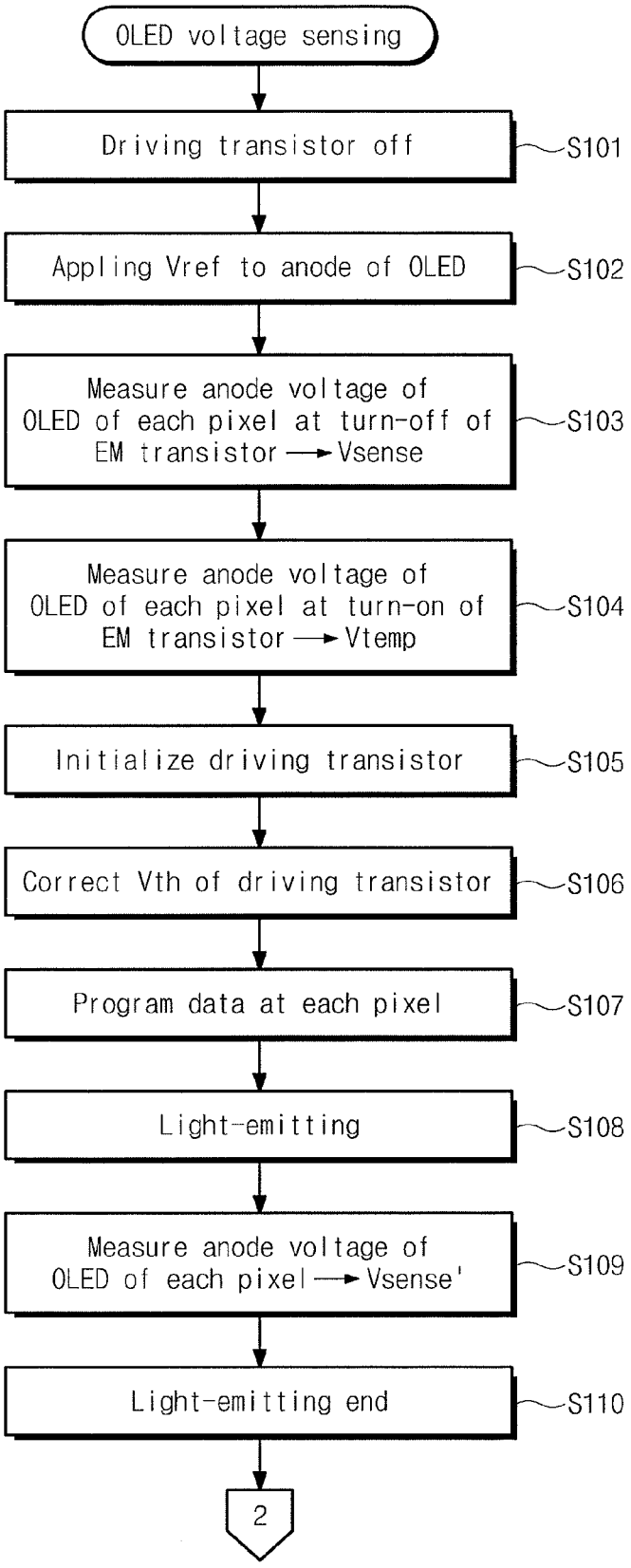
FIG. 20 illustrates another embodiment of a control method.
Figure 21:
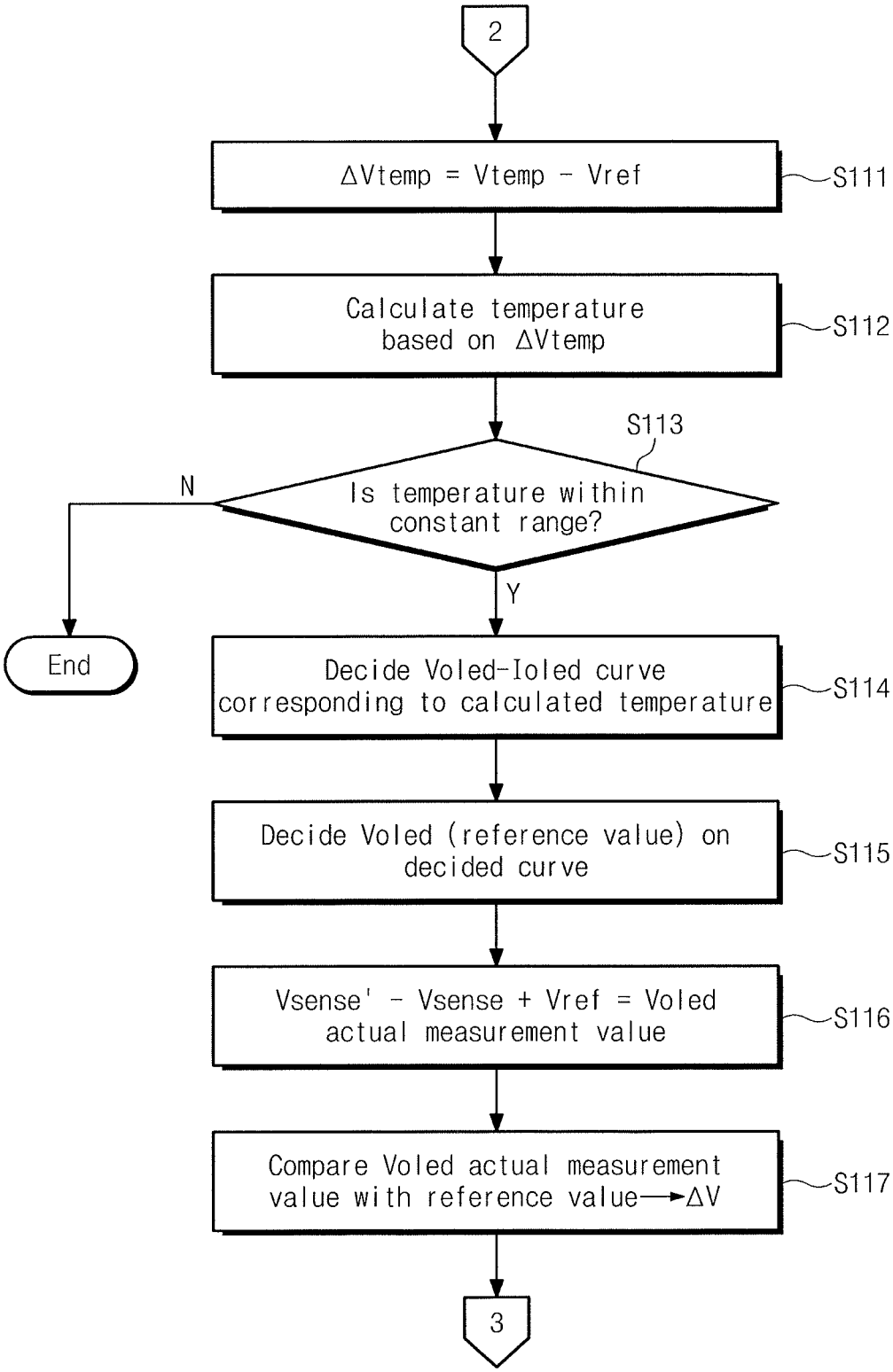
FIG. 21 illustrates another embodiment of a control method.
Figure 22:
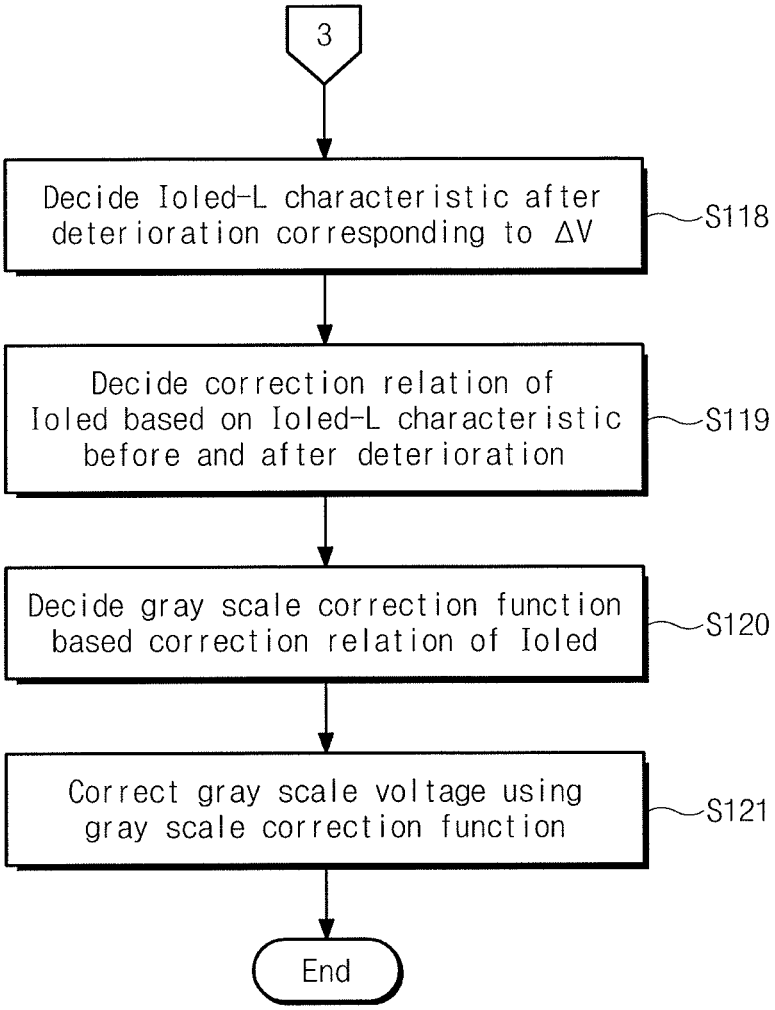
FIG. 22 illustrates another embodiment of a control method.

FIGS. 20 to 22 illustrate another embodiment of a method for controlling a pixel driving circuit using control circuit 2. This method may be discussed relative to the circuit diagrams in FIG. 7 and FIGS. 15 to 23.

This method may start at the same timing as that the previously method embodiment. Thus, for example, operations S101 to S103 in FIG. 20 may be the same as operations S001 to S003 in FIG. 4.

Figure 23:
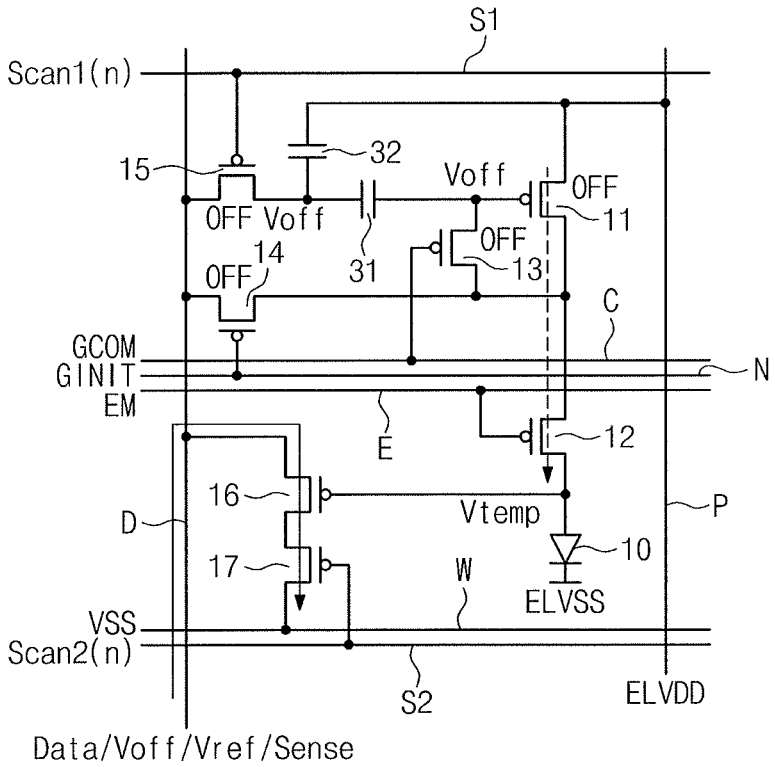
FIG. 23 illustrates an example of a driving state of a pixel circuit.
Figure 24:
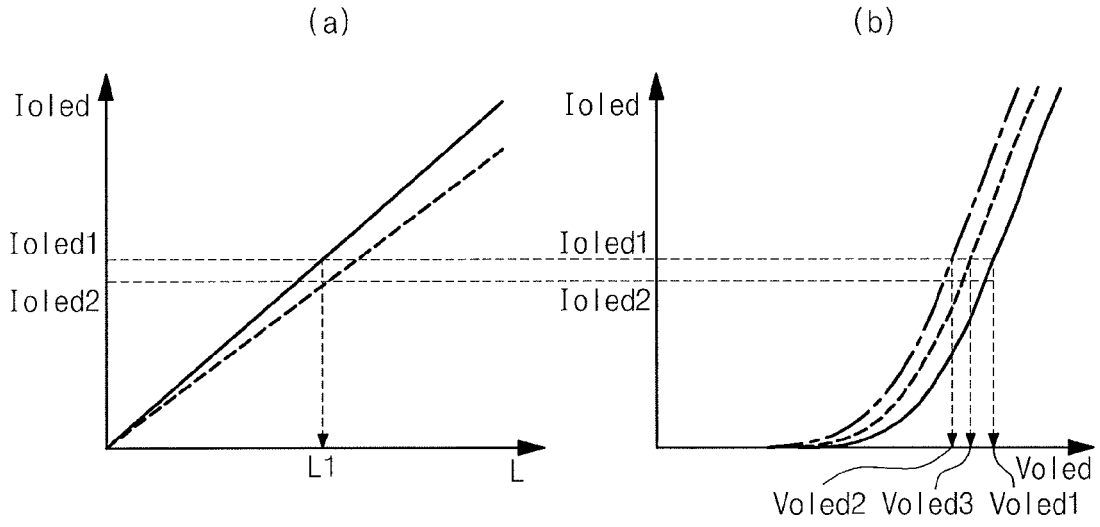
FIG. 24 illustrates an operation of the second embodiment.

In operation S104, the control circuit 2 switches the potential of a light-emitting switch driving signal EM to L (e.g., a light-emitting switch transistor 12 is turned on), for example, as illustrated in FIG. 23. Even though the driving transistor 11 is turned off, leakage current proportional to temperature flows to the OLED 10 via the driving transistor 11 and the light-emitting switch transistor 12. At this time, the anode voltage of the OLED 10 is a value Vtemp obtained by dividing a voltage difference between ELVDD and ELVSS based on the source-drain impedance of the driving transistor 11 and the impedance of the OLED 10. The control circuit 2 may receive Vtemp measured by the voltmeter 241 at a time when Vtemp is stabilized to a normal state.

Operations S105 to S110 may be the same as operations S004 to S009 in FIG. 4.

In operation S111, the control circuit 2 subtracts Vref, measured in operation S103, from Vtemp, measured in operation S104, to calculate an increment ΔVtemp of the anode voltage of the OLED 10 due to leakage current corresponding to the temperature of the OLED 10.

In operation S112, the control circuit 2 calculates the temperature based on the increment ΔVtemp calculated in operation S111. The temperature may be calculated, for example, by applying the increment ΔVtemp calculated in operation S111 to a conversion table, or to an equation for converting an increment ΔVtemp to a temperature. The conversion table and the equation may be predetermined and/or may be obtained experimentally.

In operation S113, the control circuit 2 checks whether or not the temperature calculated in operation S112 is within a predetermined (e.g., constant) range. When the temperature calculated in operation S112 is out of the range, the method ends without correcting a gray scale voltage. When the temperature calculated in operation S112 is within the range, the method proceeds to operation S114. Here, the predetermined range may be a temperature range of the environment in which the corresponding optoelectronic device is expected to be used. When the temperature calculated in operation S112 is out of range, the temperature may be considered to be in an abnormal state. Therefore, to correct a gray scale voltage under these conditions may be ineffective. For this reason, the method may be ended when the temperature calculated in operation S112 is out of range.

In operation S114, the control circuit 2 decides a voltage-current characteristic before deterioration corresponding to the temperature calculated in step S112. Decision of the voltage-current characteristic in step S114 is executed by applying the temperature calculated in step S112 to a conversion table or to an equation for converting a temperature into a shift quantity at Voled, to obtain a shift quantity. The conversion table and the equation may be obtained experimentally.

In operation S115, the control circuit 2 determines Voled (reference value) at current IoledI that the driving transistor 11 supplies according to a gray scale voltage Vgs (=Vdata−Vref−Vth) on a curve of the voltage-current characteristic obtained in operation S114. For example, the current Ioled1 that the driving transistor 11 supplies may be calculated according to a gray scale voltage Vgs (=Vdata−Vref−Vth) programmed with respect to a target OLED. The shift quantity determined in operation S114 is subtracted from Voled, which, for example, may be a predetermined value or a value experimentally obtained before shipping corresponding to the current Ioled1.

Referring to FIG. 24B, the solid line indicates a voltage-current characteristic curve when an OLED before deterioration operates at a room temperature. An alternate long and short dash line indicates a voltage-current curve predicated as a voltage-current curve of the OLED before deterioration at the room temperature calculated in operation S112.

In operation S116, the control circuit 2 calculates an actual measurement value Voled according to the following equation.

$$V\text{oled(actual measurement_value)}=V\text{sense}'-V\text{sense}+V\text{ref} \quad (6)$$

In Equation 6, Vsense indicates a voltage measured in operation S109, and Vsense" indicates a voltage measured in operation S103. Also, in FIG. 24B, the broken line indicates a voltage-current curve predicted as a voltage-current curve of an OLED after deterioration at the temperature calculated in operation S112.

In operation S117, the control circuit 2 compares the actual measurement value Voled calculated in operation S116 with a reference value determined in operation S115, to calculate a difference ΔV between the actual measurement value Voled and the reference value. In FIG. 24B, the difference ΔV is (Voled3−Voled2).

In operation S118, the control circuit 2 determines a current-luminance characteristic after deterioration corresponding to the difference ΔV.

Because a correlation exists between variation in the voltage-current characteristic and variation in the current-luminance characteristic due to time degradation of the OLED 10, the control circuit 2 calculates a slope of a current-luminance characteristic line after deterioration from a tilt angle before deterioration, based on the difference ΔV.

In operation S119, the control circuit 2 determines a correction relation of Ioled, based on a slope difference between current-luminance characteristics before and after deterioration. The correction relation may be expressed as a ratio because a slope difference between current-luminance characteristics indicates deterioration of the OLED 10.

In operation S120, the control circuit 2 determines the above-described gray scale correction function based on the correction relation determined in operation S119.

In operation S121, the control circuit 2 performs a conversion to a gray scale voltage using the above-described conversion coefficient and correction based on the gray scale correction function determined in operation S120, with respect to gray scale data of a next frame (e.g., all gray scale data received after start-up when the method in FIGS. 20 to 22 is performed only at start-up).

Also, in case a target row is one row at a time, gray scale voltage correction may be performed with respect to the target row according to the gray scale correction function determined in operation S120 of the method in FIGS. 20 to 22 currently executed. For rows other than the target row, if there is a gray scale correction function determined in operation S120 of the method in FIGS. 20 to 22 previously executed, a gray scale voltage is corrected based on the gray scale correction function that has been stored in memory. If not, no correction is performed. After an operation corresponding to operation S121 is completed, the method of FIGS. 20 to 22 ends.

In the second embodiment, a temperature is calculated based on leakage current of the driving transistor 11, a voltage-current characteristic of the OLED 10 before deterioration at the temperature is predicted according the calculated temperature, and a difference ΔV between an actual measurement value and a voltage on the predicted voltage-current characteristic is calculated. Thus, it is possible to prevent abnormal operation due to the temperature.

Modified Embodiment

An optoelectronic device according to another embodiment uses an OLED that depends on a temperature and of which the current-luminance characteristic is not changed. However, even for an optoelectronic device having an OLED element that depends on temperature and of which the current-luminance characteristic is changed, correction may be performed by measuring temperature and Voled by which predetermined current flows, under a condition where a relation between current-voltage and current-luminance characteristics before deterioration at each temperature and current-voltage and current-luminance characteristics after deterioration at each temperature is known.

Figure 25:
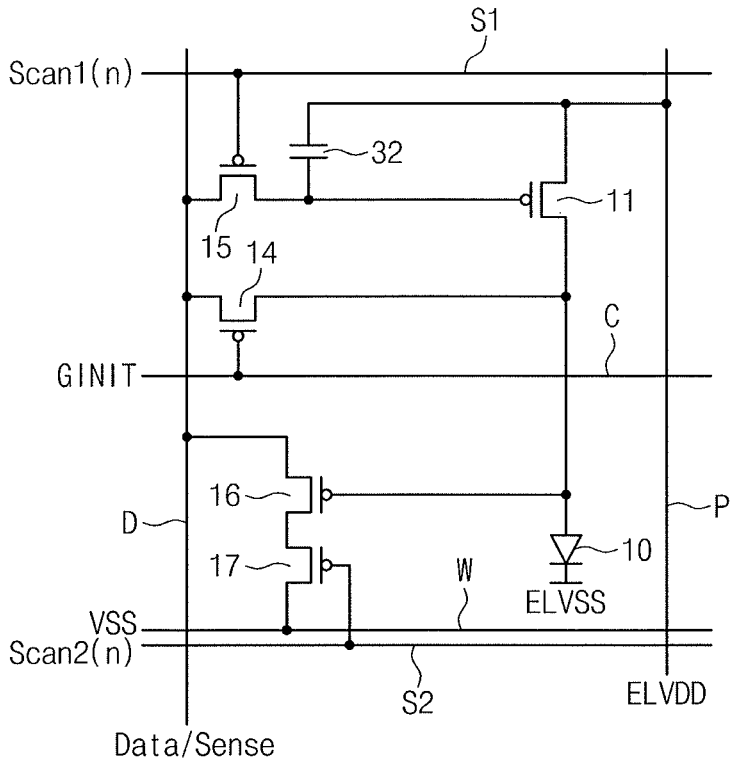
FIG. 25 illustrates another embodiment of a pixel circuit.

FIG. 25 illustrates another embodiment of a pixel driving circuit, which, for example, may be included in pixel circuit 1 of an optoelectronic device that corresponds to a third embodiment. Compared to the first and second embodiments, the third embodiment does not have a circuit to compensate for the threshold voltage Vth of the driving transistor 11 or non-uniform β. However, even when the threshold voltage Vth or β of the driving transistor 11 is irregular, the non-uniformity externally appears as a variation in the luminance characteristic of the OLED 10. The non-uniformity may therefore be corrected by compensating for the current-luminance characteristic due to the time degradation of the OLED 10. The remaining features of the third embodiment may be the same as in the first and second embodiments.

Figure 26:
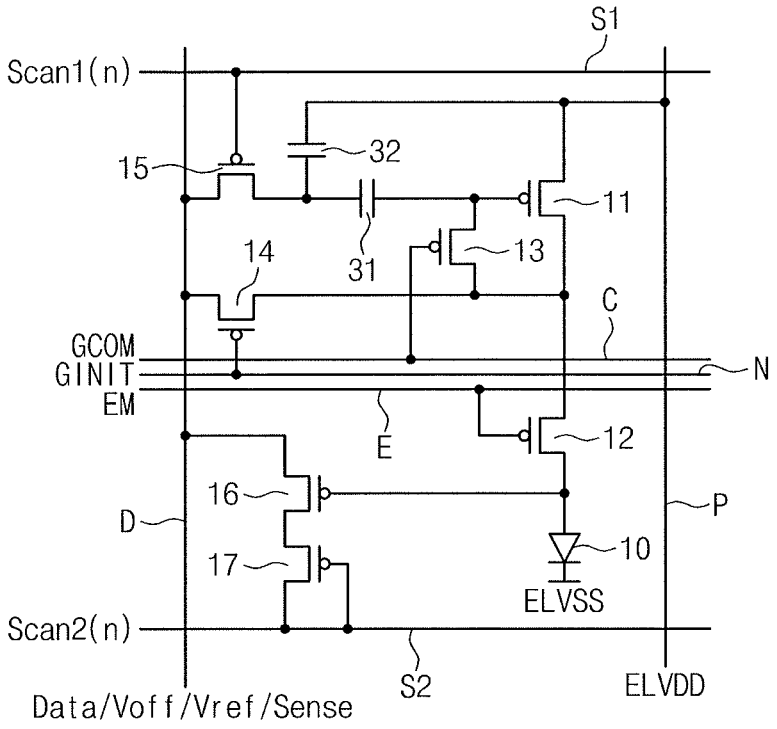
FIG. 26 illustrates another embodiment of a pixel circuit.

FIG. 26 illustrates another embodiment of a pixel driving circuit which may be included in an optoelectronic device according to a fourth embodiment. The fourth embodiment differs from the first and second embodiments in that the drain of the second scan transistor 17 is diode-connected to the second scan line S2. Thus, the effect may be the same as in the first and second embodiments.

Modified Embodiment

The first to fourth embodiments of the pixel driving circuit are implemented using p-channel MOSFETs. Alternatively, the pixel driving circuit embodiments may be implemented by n-channel MOSFETs, or a combination of p-channel and n-channel MOSFETs.

By way of summation and review, an OLED of an optoelectronic device includes a light-emitting layer. Because the light-emitting layer is made of an organic compound, its time degradation is greater than that of a light-emitting element formed of a typical silicon semiconductor. The current-luminance characteristic of the OLED varies due to this time degradation. These effects may damage or adversely affect the reproduction of an original image. For example, the time degradation may cause each OLED in the optoelectronic device to emit light with a different luminance or at different intensities for the same current value.

Theoretically, deterioration of the image reproduction resulting from a variation in the current-luminance characteristic may be corrected by adjusting a coefficient for converting an image signal into a current value based on luminance of each OLED. However, in reality, it is difficult to measure variation in the luminance value of each OLED directly.

Various techniques have been proposed in an attempt have been made to correct this problem. One technique involves directly measuring the voltage of an anode terminal of an OLED using a voltmeter connected in parallel between the anode terminal of the OLED and ground.

However, this technique is problematic because the amount of current supplied to the OLED is small. That is, the terminal voltage of the voltmeter connected in parallel to the OLED becomes the same as the anode terminal voltage, after a point in time when parasitic capacitance of a line (sense line) connecting both sides is saturated. This makes a portion of current supplied to the OLED diverge into the sense line. If the charge stored in the parasitic capacitance of the sense line is not interrupted, the voltmeter is unable to measure a voltage of the anode terminal of the OLED.

However, because the amount of current supplied to the OLED is below about several μA, even under the condition of maximum luminance, the amount of current diverging into the sense line is small. Thus, significant time is taken to charge and discharge the parasitic capacitance of the sense line. Thus, according to the aforementioned technique, because the voltage is not measured with a good response, it is difficult to correct image reproduction by adjusting a conversion coefficient under the condition that the response is good.

Also, if the amount of current supplied to the sense line is small, the potential of the sense line is easily affected by noise. For this reason, the voltage of the sense line may vary due to the noise without or outside of a panel. As a result, it is difficult to obtain sufficient measurement precision. If the length of the sense line is increased according to the size of the panel, the problem resulting from that the small current becomes even more significant.

However, in accordance with one or more embodiments, because a line diverging from the anode of an OLED is electrically connected to the gate of the sensing transistor, the time for charging the line is inconsequential. Also, the current to be provided to a voltmeter of a voltage detection unit is supplied from a constant current source, thereby making it possible to increase the current to the voltmeter to more than that to be provided to the OLED. Thus, the voltage is measured within a relatively short time, because a sense line connected to the voltmeter is instantly charged. Also, the measured voltage is not distorted or otherwise changed due to noise.

Also, a temperature is calculated based on leakage current of the driving transistor, a voltage-current characteristic of the OLED before deterioration at the temperature is predicted according the calculated temperature, and a difference ΔV between an actual measurement value and a voltage on the predicted voltage-current characteristic is calculated. Thus, it is possible to prevent abnormal operation due to the temperature.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An optoelectronic device comprising:

a first transistor electrically connected between a power supply and an electrode of at least one light-emitting element, the first transistor having a gate to receive a gray scale voltage, and to supply the at least one light-emitting element with a driving current corresponding to the gray scale voltage;

a second transistor having a gate electrically connected to the electrode of the at least one light-emitting element and a source or drain electrically connected to a circuit including a voltmeter; and a control circuit to read a measurement value of the voltmeter when the gate of the first transistor receives the gray scale voltage, and to correct a next gray scale voltage applied to the gate of the first transistor based on the measurement value, wherein the control circuit:

reads a measurement value of the voltmeter as a first measurement value when a reference voltage is applied to the electrode of the at least one light-emitting element, reads a measurement value of the voltmeter as a second measurement value when the gate of the first transistor receives the gray scale voltage, and corrects the next gray scale voltage to be applied to the gate of the first transistor based on a difference between the first measurement value and the second measurement value.

2. The device as claimed in claim 1, further comprising:

a third transistor to selectively apply the reference voltage to the electrode of the at least one light-emitting element, wherein the control circuit:

reads the measurement value of the voltmeter as the first measurement value, with the third transistor controlled such that the reference voltage is applied to the electrode of the at least one light-emitting element, and reads the measurement value of the voltmeter as the second measurement value, with the third transistor controlled such that the reference voltage is not applied to the electrode of the at least one light-emitting element and when the gate of the first transistor receives the gray scale voltage.

3. The device as claimed in claim 2, wherein:

a reset voltage is selectively applied to the gate of the first transistor, and the control circuit reads the first measurement value when the reset voltage is applied to the gate of the first transistor.

4. The device as claimed in claim 3, wherein the reset voltage, the gray scale voltage, and the reference voltage are supplied from the control circuit via a common data line.

5. The device as claimed in claim 4, wherein the circuit including the voltmeter is electrically connected to the second transistor via the data line.

6. The device as claimed in claim 5, further comprising:

a first scan transistor and a second scan transistor, wherein the first scan transistor is controlled by the control circuit and connects the data line and the gate of the first transistor, and wherein the second scan transistor is controlled by the control circuit and opens and shuts the circuit including the voltmeter.

7. The device as claimed in claim 3, further comprising:

a capacitor electrically connected between the gate and a source of the first transistor to hold the reset voltage or the gray scale voltage.

8. The device as claimed in claim 3, wherein the at least one light-emitting element includes a plurality of light-emitting elements, and wherein the first and second transistors are provided for each of the light-emitting elements.

9. The device as claimed in claim 2, wherein the control circuit:

uses, as a reference value, a voltage generated at the electrode of the at least one light-emitting element before deterioration occurs as a result of current that the first transistor supplies to the at least one light-emitting element when the gate of the first transistor receives the grays scale voltage, and corrects the next gray scale voltage applied to the gate of the first transistor based on a deviation of the difference from the reference value.

10. An optoelectronic device, comprising:

a first transistor electrically connected between a power supply and an electrode of a light-emitting element, the first transistor having a gate to receive a gray scale voltage or a reset voltage, the first transistor to supply the light-emitting element with a driving current corresponding to the gray scale voltage when the gate of the first transistor receives the gray scale voltage, and to turn off when the gate of the first transistor receives the reset voltage;

a second transistor having a gate electrically connected to the electrode of the light-emitting element and a source or drain electrically connected to a circuit including a voltmeter and a power; and a control circuit to read a measurement value of the voltmeter as a temperature measurement value when the gate of the first transistor receives the reset voltage, to read a measurement value of the voltmeter as a voltage measurement value when the gate of the first transistor receives the gray scale voltage, to correct the voltage measurement value according to the temperature measurement value, and to correct a next gray scale voltage applied to the gate of the first transistor based on the voltage measurement.

11. The device as claimed in claim 10, further comprising:

a third transistor to selectively apply a reference voltage to the electrode of the light-emitting element, wherein the control circuit is to:

read a measurement value of the voltmeter as a third measurement value with the reset voltage applied to the gate of the first transistor, apply the reset voltage to the gate of the first transistor and to read a measurement value of the voltmeter as a first measurement value with the third transistor controlled so that the reference voltage is applied to the electrode of the light-emitting element, apply the gray scale voltage to the gate of the first transistor and to read a measurement value of the voltmeter as a second measurement value with the third transistor controlled so that the reference voltage is not applied to the electrode of the light-emitting element, and calculate a difference between the first and second measurement values, correct the difference based on the third measurement value, and correct the next gray scale voltage to be applied to the gate of the first transistor based on the corrected difference.

12. The device as claimed in claim 11, wherein the control circuit is to:

use, as a reference value, a value obtained by shifting a voltage based on the third measurement value, the voltage generated at the electrode of the light-emitting element before deterioration due to current that the first transistor supplies to the light-emitting element when the first transistor receives the gray scale voltage, and correct the next gray scale voltage applied to the gate of the first transistor based on a deviation of the difference from the reference value.

13. An apparatus, comprising:

an interface; and a controller coupled to the interface and to:

(a) read a measurement value of a voltmeter electrically connected to a source or drain of a second transistor of a pixel driving circuit when a gate of a first transistor of the pixel driving circuit receives a gray scale voltage, the second transistor having a gate electrically connected to a light-emitting element, the first transistor electrically connected between a power supply and the light-emitting element, and (b) correct a subsequent gray scale voltage to be applied to the gate of the first transistor based on the measurement value, wherein the controller is to:

read a measurement value of the voltmeter as a first measurement value, the first measurement value to be read when a reference voltage is applied to the light-emitting element, and read a measurement value of the voltmeter as a second measurement value, the second measurement value to be read when the gate of the first transistor receives the gray scale voltage, and correct the subsequent gray scale voltage to be applied to the gate of the first transistor based on a difference between the first measurement value and the second measurement value.

14. The apparatus as claimed in claim 13, wherein the controller is to read the measurement value of the voltmeter as the second measurement value, the second measurement value to be read when the reference voltage is not applied to the light-emitting element and when the gate of the first transistor receives the gray scale voltage.

15. The device as claimed in claim 14, wherein the controller is to read the first measurement value when a reset voltage is applied to the gate of the first transistor.

16. The device as claimed in claim 15, wherein the controller is to supply the reset voltage, the gray scale voltage, and the reference voltage through a same line.

17. The device as claimed in claim 16, wherein the same line is a data line.

18. The device as claimed in claim 17, wherein the voltmeter is electrically connected to the second transistor via the same data line.

19. The device as claimed in claim 17, wherein the controller is to:

control a first scan transistor which connects the data line and the gate of the first transistor, and control a second scan transistor which opens and shuts a circuit including the voltmeter.

20. The device as claimed in claim 13, wherein the controller is to:

determine a reference characteristic curve of the light-emitting element before deterioration of the light-emitting element occurs, determine a deterioration characteristic curve of the light-emitting element after the deterioration of the light-emitting element occurs, and correct the subsequent gray scale voltage applied to the gate of the first transistor based on a difference between the reference characteristic curve and the deterioration characteristic curve.

* * * * *